US006648365B1

(12) United States Patent
Laughlin et al.

(10) Patent No.: US 6,648,365 B1
(45) **Date of Patent: *Nov. 18, 2003**

(54) SNOWBOARD BINDING

(75) Inventors: James Laughlin, Burlington, VT (US); David J. Dodge, Williston, VT (US)

(73) Assignee: The Burton Corporation, Burlington, VT (US)

( * ) Notice: Subject to any disclaimer, the term of this patent is extended or adjusted under 35 U.S.C. 154(b) by 44 days.

This patent is subject to a terminal disclaimer.

(21) Appl. No.: 09/650,271

(22) Filed: Aug. 28, 2000

Related U.S. Application Data

(63) Continuation-in-part of application No. 08/780,721, filed on Jan. 8, 1997, now Pat. No. 6,123,354.

(51) Int. Cl.[7] ..... A63C 9/99

(52) U.S. Cl. ..... 280/624; 280/14.22; 280/632; 280/11.36

(58) Field of Search ..... 280/14.21, 14.22, 280/624, 625, 626, 629, 632, 634, 623, 11.36

(56) References Cited

U.S. PATENT DOCUMENTS

| | | | |
|---|---|---|---|
| 4,097,062 | A | 6/1978 | Salomon |
| 4,403,789 | A | 9/1983 | Hickey |
| 4,505,493 | A | 3/1985 | Gustavsson |
| 4,624,646 | A | 11/1986 | Strohmeier |
| 4,846,492 | A | 7/1989 | Bataille |
| 4,856,808 | A | 8/1989 | Longoni |
| 4,891,027 | A | 1/1990 | Plunkett |
| 4,973,072 | A | 11/1990 | Stritzl et al. |
| 4,973,073 | A | 11/1990 | Raines et al. |
| 4,979,760 | A | 12/1990 | Derrah |

(List continued on next page.)

FOREIGN PATENT DOCUMENTS

| | | | |
|---|---|---|---|
| DE | 197 43 569 | A | 4/1999 |
| EP | 0680775 | A2 | 8/1995 |
| EP | 0680775 | A2 | 11/1995 |
| EP | 0838250 | A1 | 4/1998 |
| FR | 2 732 230 | A | 10/1996 |

(List continued on next page.)

*Primary Examiner*—James S. McClellan
(74) *Attorney, Agent, or Firm*—Wolf, Greenfield & Sacks, P.C.

(57) ABSTRACT

A snowboard binding mechanism for securing a snowboard boot to a snowboard includes at least one moveable engagement member having an open position and at least one closed position. When in the closed position, the engagement member is biased toward the open position. As a result, when a snowboard boot is not disposed in the binding mechanism, the binding mechanism automatically moves to the open position. The engagement member may also function to compensate for snow, ice or debris accumulated beneath the boot. A single handle may be operatively connected to the engagement members to facilitate ease of removal of the snowboard boot from the binding by simply requiring actuation of the single handle to unlock the binding. A separate foot pedal may be operably coupled to the engagement member and is also employed to unlock the binding. The binding mechanism may also include a cocking feature that unlocks the binding mechanism without also causing the engagement members to move to open positions. A non-metallic heel hoop may be adjustably mounted to the base of a binding for movement in a forward and rearward direction relative to the base. The heel hoop is mounted at a location on the base such that no portion of the heel hoop extends forward of the engagement member. The heel hoop may also include a base portion that is adapted to at least partially underlie the sole of the boot when the boot is held within the binding.

29 Claims, 12 Drawing Sheets

U.S. PATENT DOCUMENTS 5,028,068 A 7/1991 Donovan
5,044,655 A 9/1991 Garau
5,094,470 A 3/1992 Riedel
5,142,798 A 9/1992 Kaufman et al.
5,143,396 A 9/1992 Shaanan et al.
5,145,202 A 9/1992 Miller
5,236,216 A 8/1993 Ratzek
5,261,689 A 11/1993 Carpenter et al.
5,277,635 A 1/1994 Gillis
5,299,823 A 4/1994 Glaser
5,354,088 A 10/1994 Vetter et al.
5,401,041 A 3/1995 Jespersen
5,417,443 A 5/1995 Blattner et al.
5,433,636 A 7/1995 Gillis
5,435,080 A 7/1995 Meiselman
5,505,478 A 4/1996 Napoliello
5,520,406 A 5/1996 Anderson et al.
5,558,355 A 9/1996 Henry
5,577,756 A 11/1996 Caron
5,577,757 A 11/1996 Riepl et al.
5,595,396 A 1/1997 Bourdeau
5,660,410 A 8/1997 Alden
5,664,344 A 9/1997 Marmonier
5,669,630 A 9/1997 Perkins et al.
5,690,350 A 11/1997 Turner et al.
5,690,351 A 11/1997 Karol
5,695,210 A 12/1997 Goss et al.
5,697,631 A 12/1997 Ratzek et al.
5,713,587 A 2/1998 Morrow et al.
5,713,594 A 2/1998 Jenni
5,722,680 A 3/1998 Dodge
5,732,959 A 3/1998 Soejima
5,755,046 A 5/1998 Dodge
5,782,476 A 7/1998 Fardie
5,794,362 A 8/1998 Polk, III et al.
5,799,957 A 9/1998 Okajima et al.
5,803,467 A 9/1998 Piotrowski
5,806,876 A 9/1998 Alden
5,813,688 A 9/1998 Dacklin
5,813,689 A 9/1998 Mansure
5,815,953 A 10/1998 Kaufman et al.
5,819,440 A 10/1998 Okajima
5,836,604 A 11/1998 Piegay
5,853,188 A 12/1998 Alden
5,855,390 A 1/1999 Hassell
5,871,226 A 2/1999 Klubitschko et al.
5,887,886 A 3/1999 Bourdeau
5,890,730 A * 4/1999 Anderson et al. ..... 280/624
5,906,058 A * 5/1999 Rench et al. ..... 36/117.1
5,906,388 A 5/1999 Neiley
5,909,894 A 6/1999 Meader et al.
5,909,946 A 6/1999 Okajima
5,913,530 A 6/1999 Berger et al.
5,915,720 A 6/1999 Turner et al.
5,927,744 A 7/1999 Knapschafer
5,938,228 A 8/1999 Bourdeau
5,941,552 A 8/1999 Beran
5,941,553 A 8/1999 Korman
5,941,555 A 8/1999 Dodge
5,944,336 A 8/1999 Fagot
5,946,827 A 9/1999 Okajima
5,954,358 A 9/1999 Bejean et al.
5,957,479 A 9/1999 Bayer et al.
5,957,480 A 9/1999 Dodge
5,967,531 A 10/1999 Saillet
5,975,557 A 11/1999 Snoke et al. ..... 280/624
6,027,136 A 2/2000 Phillips
6,050,589 A * 4/2000 Couderc et al. ..... 280/624
6,065,767 A 5/2000 Girotto et al.
6,082,026 A 7/2000 Sand et al.
6,109,643 A 8/2000 Bayer et al.
6,123,354 A 9/2000 Laughlin et al.
6,189,913 B1 * 2/2001 Morrow et al. ..... 280/613
6,209,890 B1 * 4/2001 Couderc ..... 280/14.22
6,227,552 B1 * 5/2001 Keller et al. ..... 280/14.21
6,279,924 B1 * 8/2001 Murphy et al. ..... 280/14.23
6,302,428 B1 * 10/2001 Jungkind ..... 280/624
6,357,783 B1 * 3/2002 Okajima et al. ..... 280/624

FOREIGN PATENT DOCUMENTS

FR 2741817 6/1997
FR 2803768 A1 7/2001
JP 8-308977 11/1996
JP 9-206420 8/1997
JP 3050220 4/1998
JP 3052593 7/1998
JP 3067958 2/2000
WO WO 80/00063 1/1980
WO WO90/11109 10/1990
WO WO97/18076 5/1997
WO WO97/22390 6/1997
WO WO97/31689 9/1997
WO WO 98/47582 10/1998

* cited by examiner

SNOWBOARD BINDING

This application is a continuation-in-part of application Ser. No. 08/780,721 filed on Jan. 8, 1997, now U.S. Pat. No. 6,123,354.

BACKGROUND OF THE INVENTION

1. Field of the Invention

The invention relates to a snowboard binding for securing a boot to a snowboard.

2. Related Art

Conventional bindings for soft snowboard boots include strap bindings and step-in bindings. With strap bindings, one or more straps are used to secure the snowboard boot to the binding. With step-in bindings, one or more strapless engagement members releasably engage with the boot to secure the boot in the binding.

It is an object of the present invention to provide an improved binding for mounting a boot to a snowboard.

SUMMARY OF THE INVENTION

In one illustrative embodiment, a snowboard binding mechanism for securing a snowboard boot to a snowboard is disclosed. The mechanism includes at least one movable engagement member having an open position and at least one closed position wherein the engagement member is adapted to secure the boot to the snowboard. The at least one engagement member is biased toward the open position when in the at least one closed position.

In another illustrative embodiment, a snowboard binding mechanism for securing a snowboard boot to a snowboard is disclosed. The mechanism includes a first engagement member adapted to engage a first portion of the boot and to compensate for a thickness of any snow, ice or debris lying beneath a first sole portion of the snowboard boot. The mechanism includes a second engagement member adapted to engage with a second portion of the boot and to compensate for a thickness of any snow, ice or debris lying beneath a second sole portion of the snowboard boot independently of any compensation occasioned by the first engagement member as a result of any snow, ice or debris lying beneath the first sole portion of the snowboard boot.

In another illustrative embodiment, a snowboard binding for securing a snowboard boot to a snowboard is disclosed. The binding includes a base adapted to receive the boot. The base has a heel end and a toe end and defines a longitudinal axis extending in a heel to toe direction. A first engagement member is mounted to the base for movement, about an axis extending along the longitudinal axis of the base, between an open position and a plurality of closed positions wherein the first engagement member is adapted to engage a first portion of the boot when the engagement member is in each of the closed positions. A second engagement member is mounted to the base for movement, about an axis extending along the longitudinal axis of the base, between an open position and a plurality of closed positions wherein the first engagement member is adapted to engage a second portion of the boot when the engagement member is in each of the closed positions. A single handle is operably coupled to both the first and second engagement members. The handle is constructed and arranged to unlock the engagement members so that each one of the engagement members may move from the closed position to the open position.

In another illustrative embodiment, a snowboard binding for securing a snowboard boot to a snowboard is disclosed.

The binding includes a base adapted to receive the boot. The base has a heel end and a toe end and defines a longitudinal axis extending in a heel to toe direction. A first engagement member is mounted to the base and is adapted to engage a first portion of the boot. A second engagement member is mounted to the base and is adapted to engage a second portion of the boot. The binding also includes a first locking mechanism mounted to the base for movement between a first unlocked position and a plurality of first locked positions wherein the first locking mechanism engages the first engagement member when the first locking mechanism is in each of the first locked positions and wherein the first locking member does not directly engage with the boot. A second locking mechanism is mounted to the base for movement between a second unlocked position and a plurality of second locked positions wherein the second locking mechanism engages the second engagement member when the second locking mechanism is in each of the second locked positions and wherein the second locking member does not directly engage with the boot.

In another illustrative embodiment, a snowboard binding for securing a snowboard boot to a snowboard is disclosed. The binding includes a base adapted to receive the boot and at least one engagement member movably mounted to the base between an open position and at least one closed position wherein the at least one engagement member is adapted to engage the boot. The binding also includes a handle operably coupled to the at least one engagement member. The handle is adapted to unlock the at least one engagement member so that the at least one engagement member may move from the closed position to the open position. The binding also includes a foot pedal operably coupled to the at least one engagement member. The foot pedal is adapted to unlock the at least one engagement member so that the at least one engagement member may move from the closed position to the open position.

In another illustrative embodiment, a snowboard binding for securing a snowboard boot to a snowboard is disclosed. The binding includes a base adapted to receive the boot. A first engagement member is mounted to the base for movement between a first open position and at least one first closed position wherein the first engagement member is adapted to engage a first portion of the boot. A second engagement member is mounted to the base for movement between a second open position and at least one second closed position wherein the second engagement member is adapted to engage a second portion of the boot. The second engagement member is adapted to move between the second open position and the at least one second closed position independently of the first engagement member moving between the first open position and the at least one first closed position. A single handle is operably coupled to both engagement members.

In another illustrative embodiment, a snowboard binding for securing a snowboard boot to a snowboard is disclosed. The binding includes a base adapted to receive the boot. A first engagement member is mounted to the base for movement between a first open position and at least one first closed position wherein the first engagement member is adapted to engage a first portion of the boot. A first locking mechanism is movable between a first unlocked position corresponding to the first open position of the first engagement member and at least one first locked position corresponding to the at least one first closed position of the first engagement member. The first locking mechanism locks the first engagement member in the at least one first closed position when in the at least one first locked position. A second engagement member is mounted to the base for movement between a second open position and at least one second closed position wherein the second engagement member is adapted to engage a second portion of the boot. The first engagement member is adapted to move between the first open position and the at least one first closed position independently of the second engagement member moving between the second open position and the at least one second closed position. A second locking mechanism is movable between a second unlocked position corresponding to the second open position of the second engagement member and at least one second locked position corresponding to the at least one second closed position of the second engagement member. The at least one locking mechanism locks the second engagement member in the at least one second closed position. An actuator is operably coupled to the first and second locking mechanisms. The actuator is adapted to move the first and second locking mechanisms to their unlocked positions without causing the first and second engagement members to move from their at least one closed positions to their open positions.

In another illustrative embodiment, a snowboard binding for securing a snowboard boot to a snowboard is disclosed. The binding includes a base adapted to receive the boot. At least one engagement member is movably mounted to the base between an open position and at least one closed position wherein the at least one engagement member is adapted to engage the boot. A non-metallic heel hoop is adjustably mounted to the base for movement in a forward and rearward direction relative to the base. The heel hoop is mounted at a location on the base such that no portion of the heel hoop extends forward of the at least one engagement member.

In another illustrative embodiment, a snowboard binding for securing a snowboard boot to a snowboard is disclosed. The binding includes a binding base adapted to receive the boot. A heel hoop is adjustably mounted to the binding base for movement in a forward and rearward direction relative to the binding base. The heel hoop includes a base portion that is adapted to at least partially underlie the sole of the boot when the boot is held within the binding.

BRIEF DESCRIPTION OF THE DRAWINGS

Various embodiments of the invention will now be described, by way of example, with reference to the accompanying drawings, in which.

DETAILED DESCRIPTION

Figure 1:
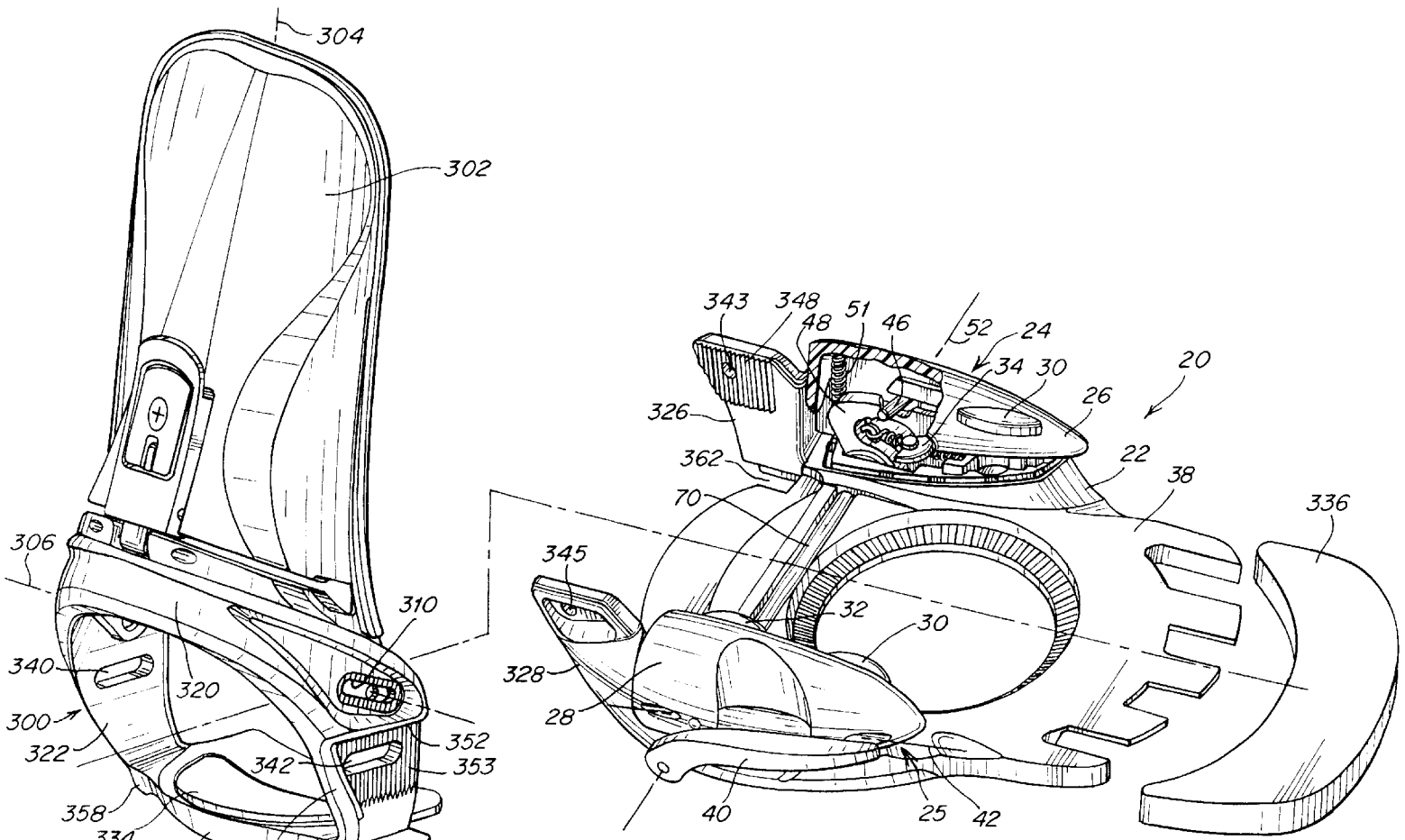
FIG. 1 illustrates a perspective exploded view of a snowboard binding according to one embodiment of the present invention.

One illustrative embodiment of the invention is directed to a step-in snowboard binding mechanism for securing a snowboard boot to a snowboard. The binding mechanism includes at least one moveable engagement member having an open position and at least one closed position. When in the closed position, the engagement member is biased toward the open position. As a result, when a snowboard boot is not disposed in the binding mechanism, the binding mechanism automatically moves to the open position wherein it may readily receive the snowboarding boot.

Another illustrative embodiment of the invention is directed to a snowboard binding mechanism that includes first and second engagement members which engage first and second portions of the boot. Each engagement member includes an open position and a plurality of closed positions that can compensate for snow, ice or debris accumulated beneath the boot. The closed positions of the engagement members are independent, so that any variability in the thickness of snow, ice or debris may be separately compensated for.

Another illustrative embodiment of the invention is directed to a snowboard binding mechanism that includes engagement members that are adapted to rotate toward and away from the snowboard boot, and to engage with the boot. Advantageously, a single handle is operatively connected to both engagement members to facilitate ease of removal of the snowboard boot from the binding by simply requiring actuation of the single handle to cause both engagement members to disengage from the snowboard boot.

Another illustrative embodiment is directed to a snowboard binding that includes a handle operably mounted to an engagement member to unlock the engagement member. A separate foot pedal is operably coupled to the engagement member and can be employed to unlock the engagement member. Thus, once a rider has released one of his or her boots from its associated binding, the rider may then simply depress the foot pedal with the free boot to remove the other boot from the binding without having to bend down to actuate the handle.

Another illustrative embodiment is directed to a snowboard binding that includes first and second engagement members adapted to independently rotate between open and closed positions, and wherein a single handle is operably coupled to both engagement members.

Another illustrative embodiment is directed to a snowboard binding that includes first and second engagement members to engage with a boot and first and second locking mechanisms that respectively lock the first and second engagement members. An actuator is operably coupled to the locking mechanisms and is adapted to unlock the locking mechanisms without also causing the first and second engagement members to move to open positions.

Another illustrative embodiment is directed to a snowboard binding that includes at least one engagement member and a non-metallic heel hoop that is adjustably mounted to the base of the binding for movement in a forward and rearward direction relative to the base. The heel hoop is mounted at a location on the base such that no portion of the heel hoop extends forward of the engagement member.

Another embodiment is directed to a snowboard binding that includes a base and a heel hoop mounted to the base for movement in a forward and rearward direction. The heel hoop includes a base portion that is adapted to at least partially underlie the sole of the boot when the boot is held within the binding.

It should be appreciated that various combinations of the above-described embodiments of the present invention can be employed together, but several aspects of the present invention are not limited in this respect. Therefore, although the specific embodiments disclosed in the figures and described in detail below employ particular combinations of the above-discussed features of the present invention, it should be appreciated that the present invention is not limited in this respect, as the various aspects of the present invention can be employed separately, or in different combinations. Thus, the particular embodiments described in detail below are provided for illustrative purposes only.

Turning now to the figures, one illustrative embodiment of a binding 20 in accordance with the present invention is shown in FIGS. 1–5. This embodiment of the invention incorporates many of the inventive aspects discussed above.

The embodiment of FIGS. 1–5 is a step-in binding 20 that includes a base 22 and binding mechanisms 24, 25, which respectively include engagement members 26, 28, that are movably mounted to the base 22 and engage with a snowboard boot (not shown). The step-in process, together with the features that cause the binding mechanisms 24, 25 to engage with and release the boot, are described below.

In the embodiment shown, both of engagement members 26, 28 include first and second spaced-apart engagement fingers 30, 32 that are adapted to engage in at least one corresponding recess, such as first and second spaced-apart recesses, formed in the snowboard boot. The recesses may be provided in the lateral sides of the boot and may be formed in or otherwise provided by an interface, as described in co-pending U.S. patent application Ser. No. 08/584,053, which is incorporated herein by reference. However, it should be understood that the invention is not limited in this respect, and that the binding of the present invention can be used with boots that are adapted in other ways to receive the engagement members 26, 28. Furthermore, although the use of two spaced-apart engagement fingers on one side of the boot is advantageous in that it strengthens the engagement between the binding and the boot, particularly when the boot recesses are formed in a plastic interface, it should be understood that the present invention is not limited to a binding that uses an engagement member 26 with dual engagement fingers on one side of the boot. In addition, the present invention is not limited in this respect, as the engagement members need not be of the type that engages within recesses in the boot. In this respect, aspects of the present invention are directed to a locking mechanism that locks the engagement members 26, 28 in place, and can be employed with engagement members of numerous other arrangements, and is not limited to use with the engagement members 26, 28 shown in FIGS. 1–5.

To facilitate automatic movement of the engagement members 26, 28 from the open position to the closed position as the boot is stepped into the binding, each binding mechanism 24, 25 may include a trigger 34. In the embodiment shown in FIGS. 1–5, the trigger is fixed to rotate with the engagement members 26, 28 and is adapted to at least initially engage with the boot. Thus, downward movement of the trigger 34 as the boot steps down into the binding causes the engagement member 26 to rotate downwardly. Although the binding mechanisms 24, 25 shown in FIGS. 1–5 each includes a trigger 34, the present invention is not limited in this respect, as other suitable mechanisms may be employed to cause the engagement members 26, 28 to move from the open position to the closed position.

In the embodiment shown, the binding includes a base 38 having a baseplate with the engagement members 26, 28 rotatably mounted to the base 38 for rotation between an open position, as shown in FIG. 1, and one of a series of closed positions. In the open position, the engagement members 26, 28 have rotated upwardly and away from the boot. In each closed position, the engagement members 26, 28 have rotated downwardly and toward the boot into a position where they engage the boot. To move the engagement members 26, 28 from a closed position to the open position, a handle 40 is provided that is operably coupled to the engagement members 26, 28. In some embodiments of the invention, a single handle is advantageously employed. However, other aspects of the present invention are not limited to employing a single handle.

As shown in FIG. 1, the engagement members 26, 28 are rotatably mounted to the base 38 about an axis 42 that extends substantially along the length of the base 38. Again, several aspects of the invention are not limited to arranging the rotation axis in this manner, or even to employing rotatable engagement members at all.

In the embodiment shown in FIG. 1, the binding base 38 is held to a snowboard with the use of a hold-down disk (not shown), as is well-known, although other suitable arrangements for securing the binding mechanism to the snowboard may be employed.

Figure 2A:
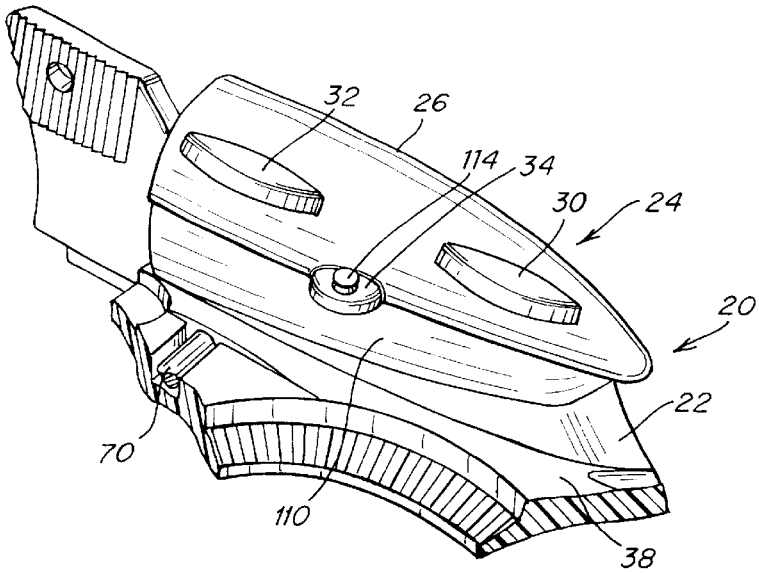
FIG. 2A is a perspective view of a portion of the snowboard binding of FIG. 1.
Figure 2B:
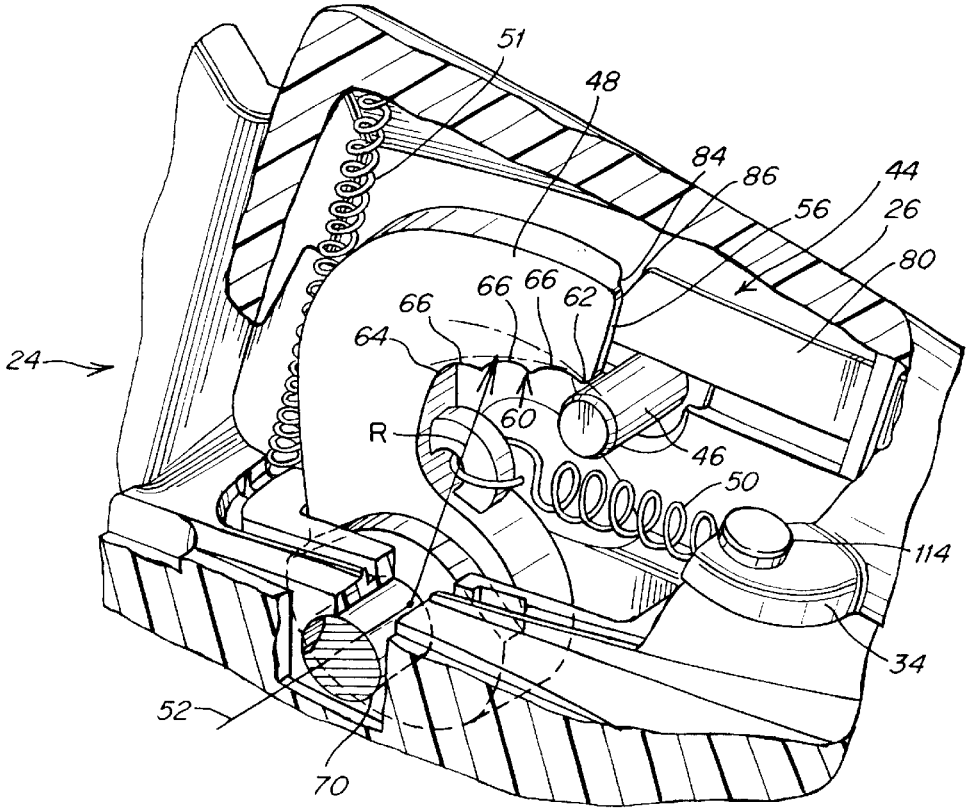
FIG. 2B is an enlarged cut-away perspective view of a portion of a locking mechanism for use in the snowboard binding of FIGS. 1 and 2A.
Figure 3:
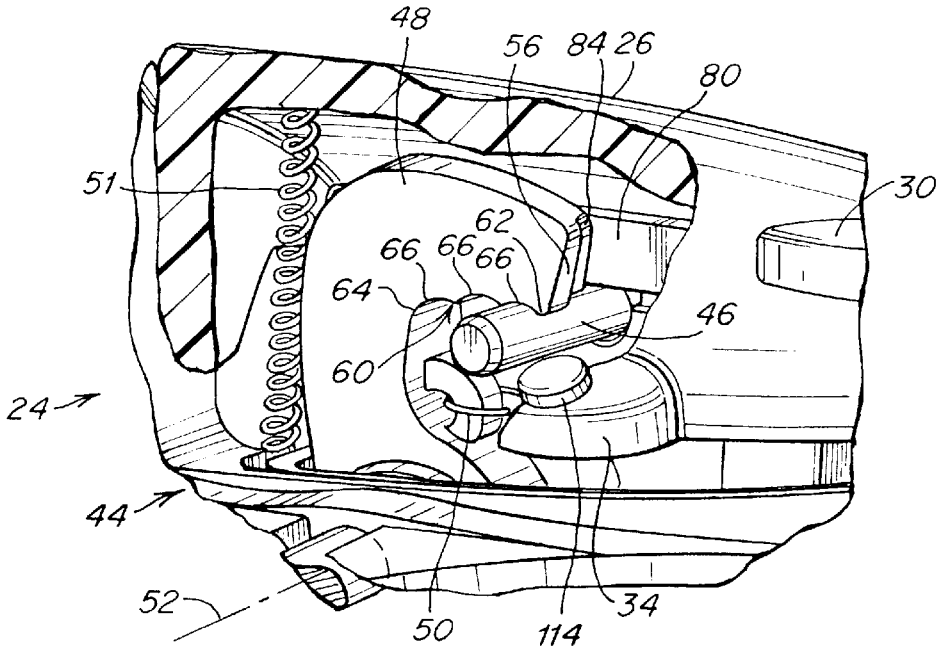
FIG. 3 is an enlarged perspective view of the portion of the locking mechanism of FIG. 2 shown in a first engaged position.

One embodiment of the invention is directed to a unique locking assembly for locking the engagement members 26, 28 in two or more closed positions. In the illustrative embodiment of FIGS. 1–7, each binding mechanism includes such a locking assembly 44, as shown in FIGS. 2–9. Each locking assembly 44 includes three major components, namely a catch pin 46 connected to the respective engagement member 26, a hook-shaped catch 48, and a biasing element (e.g., a spring 50). The catch pin 46, being fixed to the engagement member 26, is adapted to rotate with the engagement member 26 as the engagement member 26 rotates between the open and closed positions. The catch 48 is rotatably mounted to the base 38 about an axis 52 that is substantially perpendicular to the longitudinal axis of the binding and is adapted to engage the catch pin 46 to hold the engagement member 26 in the closed positions. As best shown in FIG. 2, in one embodiment the catch 48 is biased closed with the use of a coil spring 50, although other suitable biasing elements or mechanisms may be employed.

Figure 4:
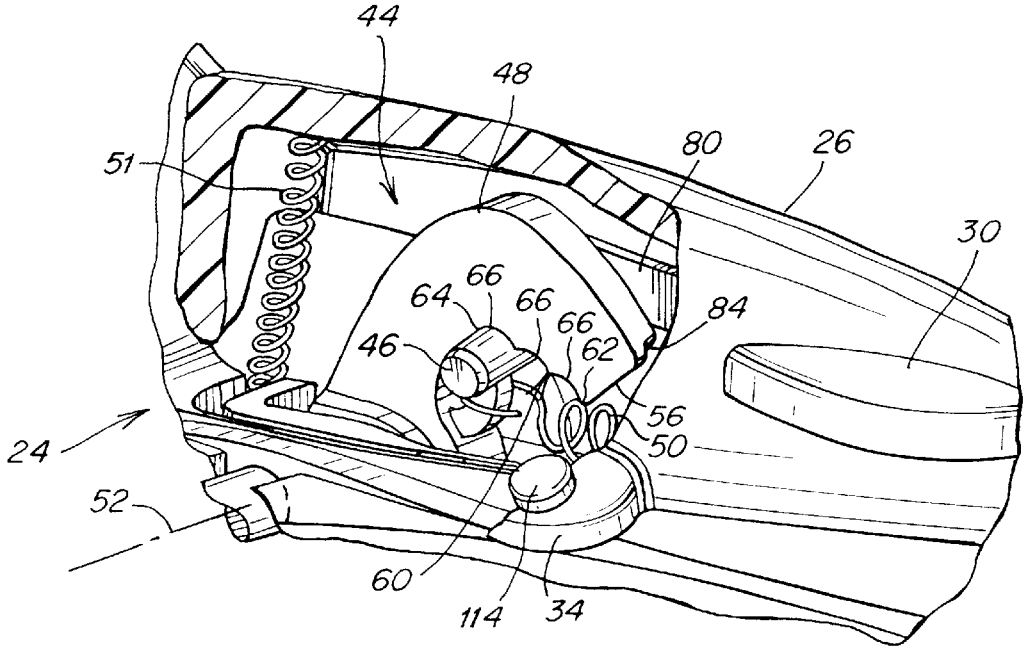
FIG. 4 is an enlarged perspective view of the portion of the locking mechanism of FIG. 2 shown in a second engaged position.
Figure 5:
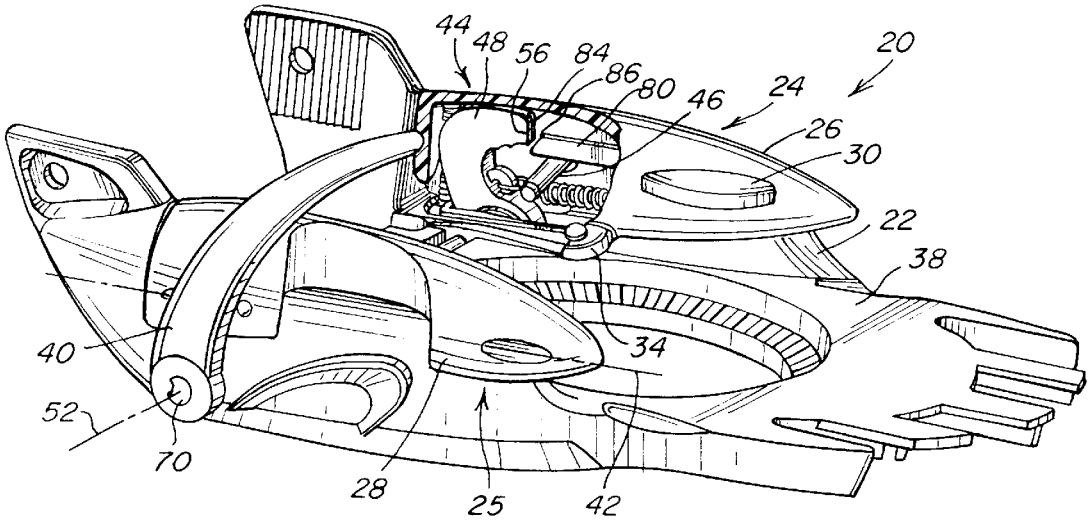
FIG. 5 is a perspective view of a portion of the binding of FIGS. 1 showing opening of the locking mechanism.

Movement between the open position, wherein the binding mechanism does not engage but is in a position to receive the boot, and the closed position, wherein the binding mechanism secures the boot, will now be described with reference to a single binding mechanism. Initially, the engagement member 26 is held in the open position due to the action of a bias spring 51 (FIG. 4). The bias spring 51 acts to bias the engagement member open over its full range of motion, so that it is always biased toward the open state, even when the lock assembly 44 secures the engagement member in one of its closed positions. The catch 48 is held in an open configuration (i.e., one where it does not secure the pin) by the interference of the catch pin 46 on an abutment surface 56 of the catch 48. As the engagement member 26 is moved downward, due to, for example, a boot stepping down on the trigger 34 to overcome the bias of the spring 51, the catch pin 46, being fixed to the engagement member 26, moves relative to the catch 48. Once the catch pin 46 moves past the abutment surface 56 (see FIG. 2), the catch 48 is drawn by the action of the biasing element (e.g., the spring 50) to rotate toward the catch pin 46. As a result, the catch 48 moves to a locked configuration wherein it engages with the catch pin 46 such that upward rotation of the engagement member 26 is prevented (see FIG. 3).

To move the engagement member 26 from the closed position to the open position, the catch 48 is rotated, for example, by actuating the handle 40, which may be coupled to the catch 48 as discussed below. Actuation of the handle overcomes the bias of the spring 50 such that the catch 48 rotates (counterclockwise in FIG. 2) to clear the catch pin 46 (see FIG. 5). At this point, the rider is free to step out of the binding as the engagement member 26 is free to rotate upward to the open position.

The embodiment of the invention shown in FIGS. 2–8 has multiple closed positions to accommodate for any snow, ice or debris that may be situated beneath the snowboard boot while ensuring that the boot is securely held in the binding. Thus, each engagement member is adapted to engage the snowboard boot in one of a plurality of closed positions depending upon the thickness of the snow, ice or other debris. Each closed position securely holds the boot in a manner that compensates for the thickness of any such snow, ice or debris. In addition, as any snow or ice melts or is dislodged from beneath the boot, the binding mechanism is constructed to allow the engagement members 26, 28 to automatically self-tighten, thereby allowing the boot to continue to be tightly secured, without the introduction of any slop or play in the engagement between the boot and binding.

To provide the plurality of closed positions to compensate for snow, ice or debris, in one illustrative embodiment, the catch 48 is provided with a locking surface 60 that has a decreasing radius of curvature R (FIG. 2) relative to the catch pivot axis 52 when viewed from the outermost point 62 on the locking surface to the innermost point 64 on the locking surface. Thus, at the outermost point 62, the catch pin 46 is in the locked position providing the greatest amount of clearance for snow, ice or debris. As the engagement member 26 is moved downward, for example, as snow, ice or debris is removed, or in response to the boot pushing downwardly on the trigger, the catch 48 is drawn by the action of the biasing element 50 to rotate toward the catch pin 46 such that the catch pin 46 engages with the catch 48 at a locking position of decreased radius. The catch 48 therefore holds the catch pin 46, and consequently the engagement member 26, in a tighter closed position that provides less clearance for snow, ice or debris. In one embodiment, the radius of curvature R of the locking surface 60 is adapted to allow the engagement member 26 to accommodate a thickness of snow, ice or debris ranging between 0 mm and 8 mm. When no snow, ice or debris is present, the sole of the boot may contact the base, if one is employed, or the snowboard directly.

To facilitate holding the catch pin 46, and consequently the engagement member 26, in one of the plurality of positions, in the embodiment shown, the locking surface 60 of the catch 48 is provided with a plurality of scallops 66. The scallops reduce the likelihood that the catch pin 46 will slip from engagement with the locking surface 60 due to the presence of water or ice on the locking surface 60 or the catch pin 46. In one embodiment, the scallops 66 have a geometry arranged to hold the catch pin 46 in a manner such that lifting forces acting upwardly on the catch pin 46 (i.e., as a result of lifting forces generated by the boot on the engagement member) tend to maintain the catch 48 in the closed position. In this respect, lifting forces tend to further seat the catch pin 46 within the scallop 66 in an over-center action, rather than causing the catch pin 46 to slip out of engagement with the catch. Thus, this provides an over-center locking assembly with multiple closed positions of varying tolerance for snow, ice or debris. It is to be appreciated, however, that the present invention is not limited in this respect, and that scallops need not be provided on the locking surface. In addition, although the embodiments disclosed herein are directed to binding mechanisms that compensate for snow, ice or debris, it should be appreciated that numerous aspects of the present invention are not limited in this respect, and can be used with binding mechanisms that employ a single closed position.

As previously discussed, to unlock the locking assembly 44 and thus the engagement members, the binding mechanism may include handle 40. As will be more fully described below, in the embodiment shown in FIGS. 1–8, the handle 40 is operably coupled to the locking assembly such that rotation of the handle 40 causes rotation of the catch 48. Thus, a rider simply actuates the handle 40 so that the catch 48 may be rotated to its open position wherein it is out of engagement with the catch pin 46. In the embodiment shown, the binding is provided with a single handle 40 that is coupled to a shaft 70 (see FIGS. 1, 5 and 6), which, in turn, is coupled to both catches 48 such that actuation of the handle 40 actuates both catches 48. Of course, numerous aspects of the present invention are not limited in this respect, as separate handles may be employed to separately actuate the two catches.

Figure 6:
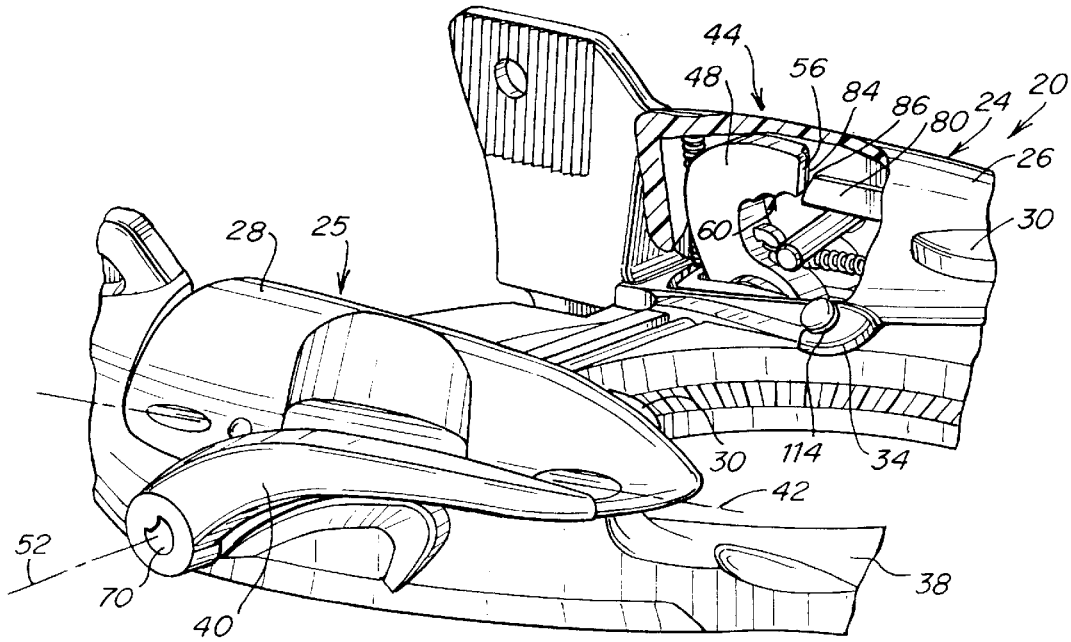
FIG. 6 is a perspective view of a portion of the binding of FIG. 1 shown in the unlocked, but engaged, position.
Figure 7A:
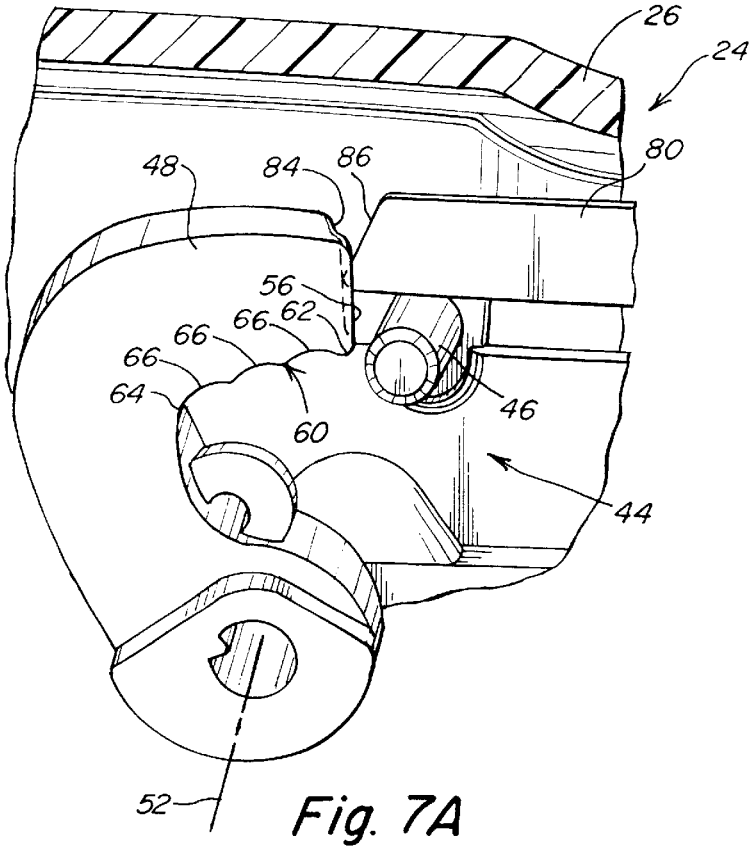
FIGS. 7A–7D show a portion of the locking mechanism of FIGS. 2–4 in unlocked and sequentially disengaged positions.
Figure 7B:
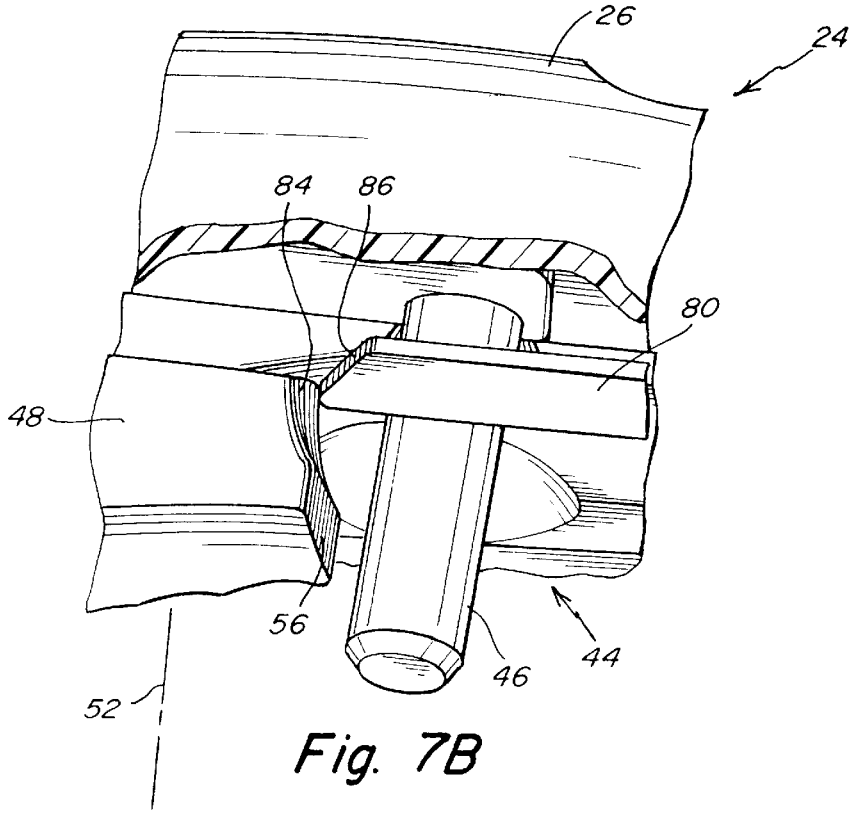
Figure 7C:
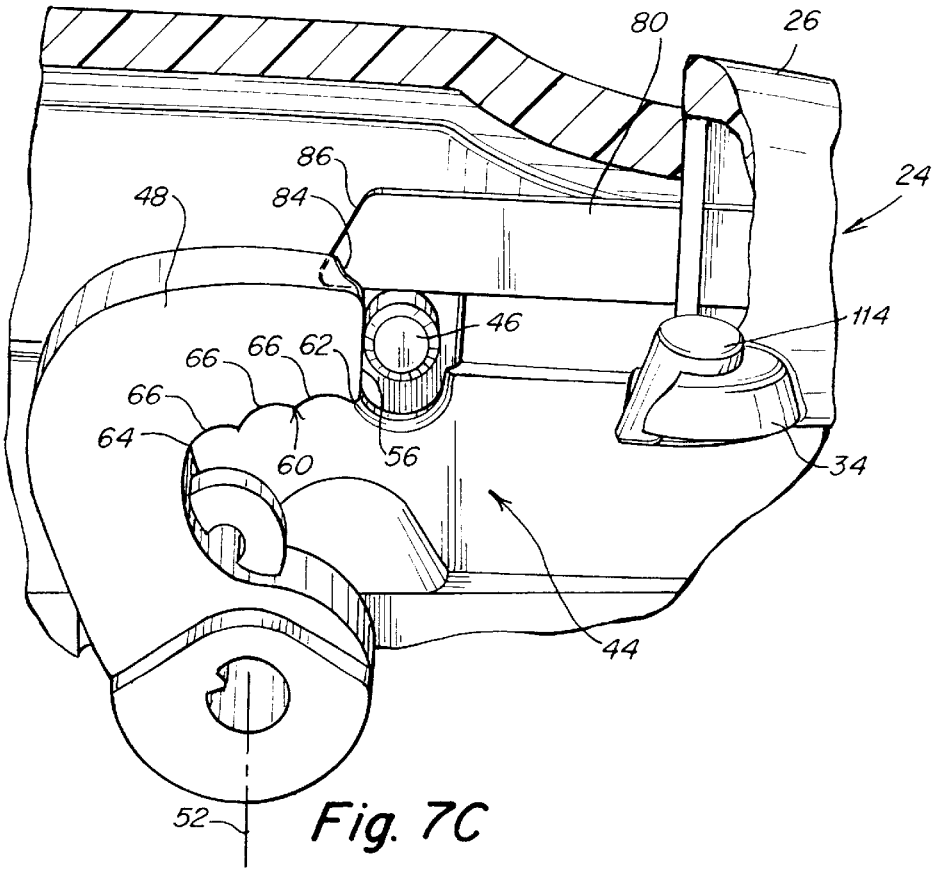
Figure 7D:
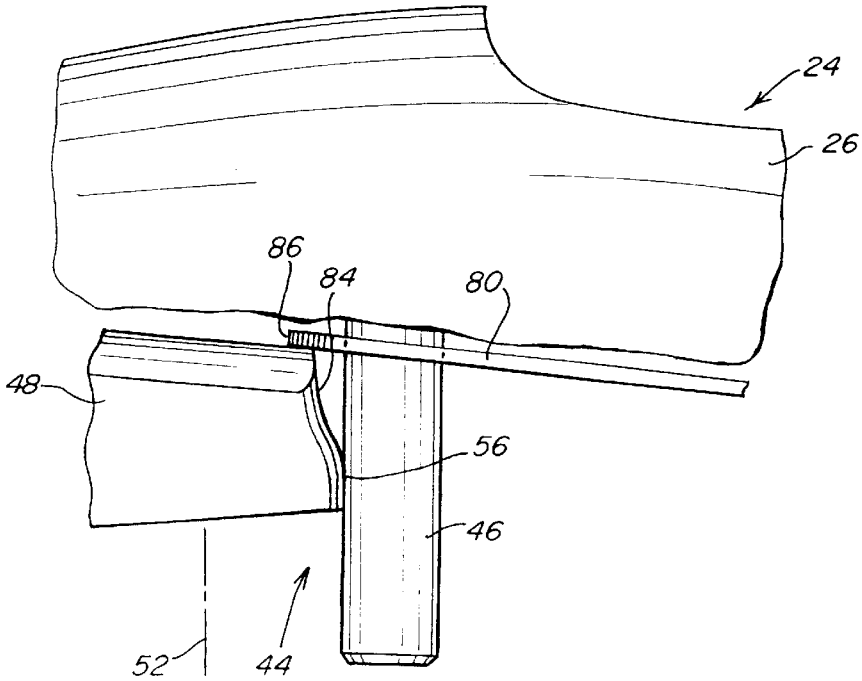

In one embodiment of the invention, the binding includes a feature that allows each binding mechanism to be cocked open so that the locking assembly unlocks without also causing the engagement members to disengage from the boot. This is advantageous because a rider may unlock the locking assembly without having to step out of the binding. Rather, the rider may step out when it is convenient, for example, after standing up from actuating the handle. In the illustrative embodiment of FIG. 5, each binding mechanism includes a catch lock 80 to implement this cocking open feature. The catch lock 80 is adapted to hold the catch 48 in the open position once the handle 40 is released. Thus, after rotation of the handle 40 to the open state of FIG. 5, a rider can release the handle 40, which, as will be explained below, can return to its rest position, as shown in FIG. 6. When the handle is released, the catch 48 does not reengage with the catch pin 46 as the catch lock 80 holds the catch 48 in its open position. Advantageously, the rider may continue to keep his boot in the binding with the catch 48 in the unlocked position. When desired, the rider merely needs to lift his or her boot out of the binding, causing the engagement members 26, 28 to rotate to the open configuration.

In the embodiment shown in FIGS. 2–8, the catch lock 80 is formed as a spring steel leaf spring fixed at one end (not shown) to the base 38 or to the engagement member itself. Of course, it is to be appreciated that other suitable configurations and materials (such as plastic) may be employed, as the present invention is not limited to any particular arrangement for cocking the binding open.

Referring now specifically to FIGS. 5–8, movement of the engagement member 26 from the closed position to the open position with the use of the cocking arrangement will now be described. Upon actuation of the handle 40, the catch 48 is cocked into an unlocked position and held in the unlocked position through the use of the catch lock 80 (see FIGS. 5 and 6). As the engagement member 26 moves from the closed position to the open position, the catch pin 46 pushes upwardly on the catch lock 80. The upward force causes the catch lock 80 to move away from engagement with the catch 48 as will be explained below. This is best shown in FIGS. 7A–7D, which show sequential movement of the engagement member 26 toward the open position as well as sequential movement of the catch lock 80 away from engagement with the catch 48. Once the engagement member 26 is in the open position, the catch pin 46 is in a position to hold the catch 48 in the open position (see FIG. 7A). That is, the catch pin 46 engages the abutment surface 56 of the catch 48 and the catch 48 is prevented from moving toward the locked position wherein it engages with the catch pin 46. At this point, the engagement members 26, 28 are returned to their open position as shown in FIG. 1.

To facilitate disengagement of the catch 48 and the catch lock 80 as the engagement member 26 moves to the open position, the abutment surface 56 and the catch lock 80 are formed with complementary cammed surfaces 84 and 86. The cammed surfaces facilitate movement of the catch lock 80 behind the catch 48 to disengage therefrom (see FIGS. 7B–7D). When the catch lock 80 is moved out of the way and the catch pin 46 is in a position to hold the catch 48 in the open position, the binding engagement member 26 is reset to the open configuration wherein it is ready to receive the boot upon the boot stepping into the binding.

Although in the embodiment described, the abutment surface 56 and the lock 80 include cammed surfaces to facilitate movement of the catch lock 80, the present invention is not limited in this respect, as other suitable arrangements for disengaging the catch and resetting the engagement members 26, 28 may be employed.

Although the embodiment discussed above includes a cocking feature, several aspects of the present invention are not limited in this respect, as they can be employed with bindings not having a cocking feature.

Figure 8:
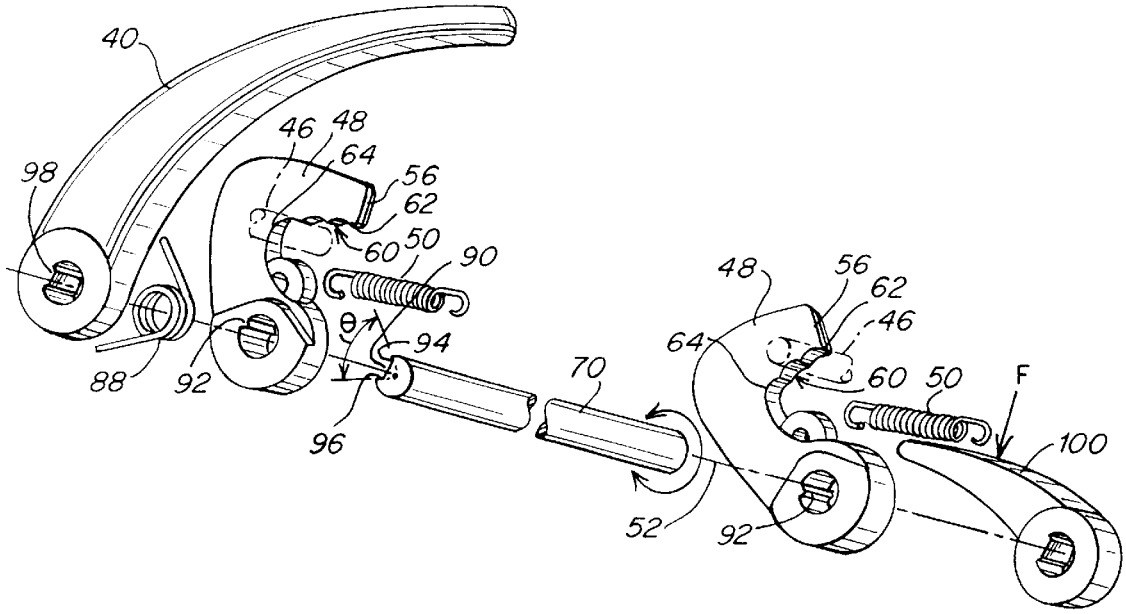
FIG. 8 is an exploded perspective view of a portion of the locking mechanism of FIGS. 1–7D.

Turning now to FIG. 8, a portion of the binding mechanism is shown. In this illustrative embodiment, the binding mechanism includes the handle 40 operably coupled to both catches via the shaft 70. Actuation of the handle 40 causes the shaft 70 to rotate, which, in turn, causes the catches 46 to rotate as described above. A torsion 88 spring may be coupled to the shaft 70 to cause the shaft 70 to rotate to its at rest position after the handle 40 has been actuated, as described above. To facilitate movement of the shaft 70, the handle 40 is keyed to the shaft 70 such that a tab 98 on the handle 40 substantially fills a channel 90 in the shaft 70. Thus, any movement of the handle 40 will affect movement of the shaft 70.

In one embodiment of the invention, the binding mechanism is allowed to compensate for snow, ice or debris accumulation that may be thicker on one side of the boot sole than on the other by enabling independent movement of the engagement members 26, 28. In the embodiment shown in FIGS. 1–8, this is accomplished by allowing the catches 48 to move independently, as shown schematically in FIG. 8, wherein the catches 48 are in different engaged positions. To allow each catch to move independently, the shaft 70, which passes through the catches 48, is provided with the channel 90 and each catch 48 is provided with a corresponding mating tab 92. The tabs on the catches are smaller in size than the channel, such that the catches are able to rotate about their axes of rotation (i.e., about the shaft 70), but only over a limited arc (e.g., approximately 46°) as defined by the edges 94, 96 of the channel 90 formed in the shaft 70.

The channel 90 in the shaft 70 serves at least one additional purpose. For example, the channel 90 allows the locking assembly 44 to be cocked open and to allow the handle 40 to be returned to its rest position after the locking assembly 44 has been cocked open. In this regard, when it is desired to move the engagement members 26, 28 to the open configuration, the handle 40 is pulled up such that the trailing edge 94 of the channel 90 will engage the tabs 92 of the catches 48 to rotate them in a direction away from the catch pin 46. In addition, because of the size of the channel 90 relative to the size of the tabs 92 on the catches 48, the handle 40 may be rotated downward to its rest position without causing the catches 48 to also move. In this regard, the leading edge 94 of the channel 90 (which was previously the trailing edge discussed above) does not engage with the tabs 92 on the catches 48.

It should be appreciated that the embodiment of the invention that employs engagement members that are independently lockable is not limited to the particular arrangement shown, as alternative arrangements for moving the catches independently of each other, as well as independently of the shaft 70, at least over certain ranges, may be employed. In addition, several aspects of the invention are not limited to employing independently movable engagement members.

In one embodiment of the invention, the binding is provided with a foot pedal 100 to enable the binding to be released by being stepped upon. The foot pedal 100 may also be keyed or otherwise attached to the shaft 70 to cause the shaft 70, and consequently the catches 48, to rotate into an unlocked position, thereby allowing the engagement members 26, 28 to rotate to the open configuration upon lifting of the boot relative to the binding. In the embodiment shown, the foot pedal 100 (FIG. 8) is stepped down upon as shown by arrow "F" in order to rotate the shaft 70. In one embodiment, the foot pedal 100 is on the medial side of the binding, whereas the handle 40 is on the lateral side, to facilitate actuation of the foot pedal 100 with the rider's other foot. However, this embodiment of the invention is not limited in this respect, as the foot pedal may be positioned on the same side of the shaft 70 as the handle 40, but yet extend in an opposite direction so that the foot pedal may be pushed down upon from the same side of the binding as the handle 40. In addition, it should be appreciated that numerous aspects of the present invention are not limited to employing a foot pedal.

Figure 9:
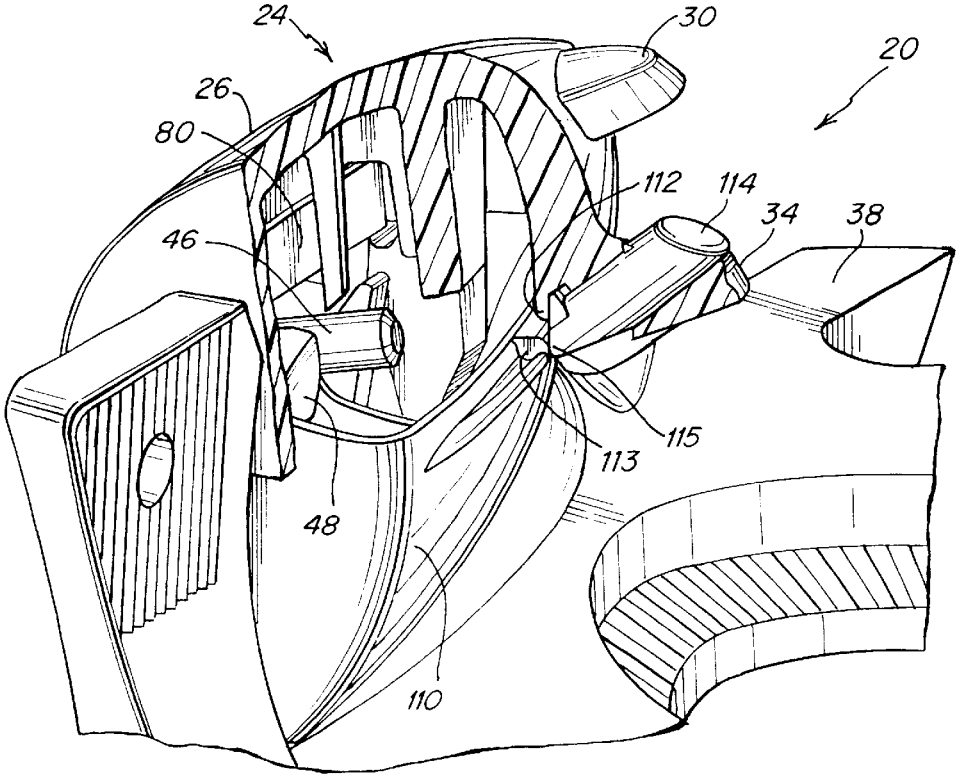
FIG. 9 is a perspective view of a portion of an alternative embodiment of the binding mechanism of FIGS. 1–8.

In one embodiment of the invention shown in FIG. 9, each binding mechanism 24, 25 includes a snow shield 110 that shields at least the locking assembly 44 from snow and ice accumulation. The snow shield 110 may be integrally formed with at least the side walls of the binding base 22 and may be formed of the same material. However, the present invention is not limited in this respect, as other suitable materials and attaching techniques may be used. To allow the engagement members to rotate downwardly, sufficient clearance between the engagement members 26, 28 and the snow shields may be provided. It should be appreciated that several aspects of the invention are not limited in this respect, as some embodiments need not employ a snow shield.

As discussed above, depending on the nature of the engagement member, it may be desirable to hold the engagement member in the open configuration to enable a boot to step into the binding. In one embodiment, the engagement member 26 is held open until a sufficient force is exerted on the engagement member 26 (e.g., via the trigger 34) to overcome the spring 51 that biases the engagement member to the open position. In another embodiment, as shown in FIG. 9, a portion 112 of the engagement member 26 may interfere with a portion 113 of the snow shield 110 such that the snow shield 110 must yield away from the engagement member 26 to allow the engagement member 26 to slide over the snow shield 110 as it moves downward. For example, the snow shield may be positioned relative to the engagement member 26 such that when the engagement member 26 is acted upon with sufficient force, the snow shield deflects so that the engagement member 26 may slide over the snow shield. Alternatively, to facilitate movement of the snow shield 110 so as not to interfere with the engagement member 26, the trigger 34 may include a movable tab 114 that moves relative to the trigger 34. As the boot steps down upon the trigger 34 and movable tab 114, a rear portion 115 of the movable tab 114 acts as a lever to push the portion 113 of the snow shield 110 away from the engagement member 26 so that the engagement member 26 may slide down over the snow shield 110. It should be appreciated that this aspect of the present invention is not limited to any particular arrangement to move the snow shield.

FIGS. 10–14 show a side view of an alternative embodiment of a step-in binding mechanism for securing a boot in a binding. In this embodiment, like the previously described embodiments, each binding mechanism 200 includes an engagement member that engages a corresponding recess formed in lateral side of the snowboard boot 201. Although one binding mechanism 200 for engaging one side of the boot is shown in FIGS. 10–14, it is to be appreciated that another binding mechanism is positioned on the opposite side of the boot, and operates in an identical manner. As discussed above, several aspects of the present invention are not limited to a boot having recesses in which to receive the engagement members, as other engagement arrangements between the boot and the binding may be employed.

In the embodiment shown, the binding mechanism 200 includes an engagement member 202, a trigger 204, a catch pin 206, a catch 208 and a handle 210. In this embodiment, the two binding mechanisms are not coupled together, neither by a shaft nor otherwise. Unlike the embodiments described above, in this embodiment, the trigger 204 is movable relative to the engagement member 202. The engagement member 202 and trigger each is always biased toward its open position over its full range of motion. However, for the sake of clarity, the biasing elements are not shown in the figures, although the direction of the bias is shown by the arrows "A", "B" and "C" in FIGS. 10–14. It is to be appreciated that the bias on the components may be implemented in any suitable manner, as the present invention is not limited to any particular biasing techniques. Examples of such bias elements include, but are not limited to, coil springs, torsion springs, leaf springs, as well as spring-actuated lever mechanisms. For example, the bias provided for the trigger 204 in the direction of arrow "A" may be implemented with a spring biased lever arm 211 (FIGS. 12 and 14) that acts on catch pin 206.

Each binding mechanism 200 may include a frame 212. The frame 212 may be mounted directly to the snowboard 216. However, in the illustrative embodiment described, the frame 212 is mounted to a base 214, which, in turn, may be mounted to the snowboard using a hold-down disk (not shown) as described above. Alternatively, the frame 212 may be an integral component of the base.

The engagement member 202 is similar to the engagement member described with reference to FIGS. 1–9. Namely, the engagement member 202 includes a pair of spaced-apart engagement fingers 218 (only one of which is shown) that separately engage corresponding spaced-apart recesses 220 formed in the sidewall of the snowboard boot 201. However, as with the embodiments discussed above, other suitable engaging configurations may be employed, as the locking assembly of FIGS. 10–14 is not limited to use with any particular engagement member and/or boot configuration.

In the embodiment shown, the engagement member 218 is pivotally attached to the frame 212 for rotation about a pivot pin 222 between an open position (shown in FIG. 10) and multiple closed positions. In the embodiment described, the engagement member 202 is biased toward the open position as shown by arrow "B" and rotates about an axis 224 that extends substantially along the longitudinal axis of the binding.

Figure 10:
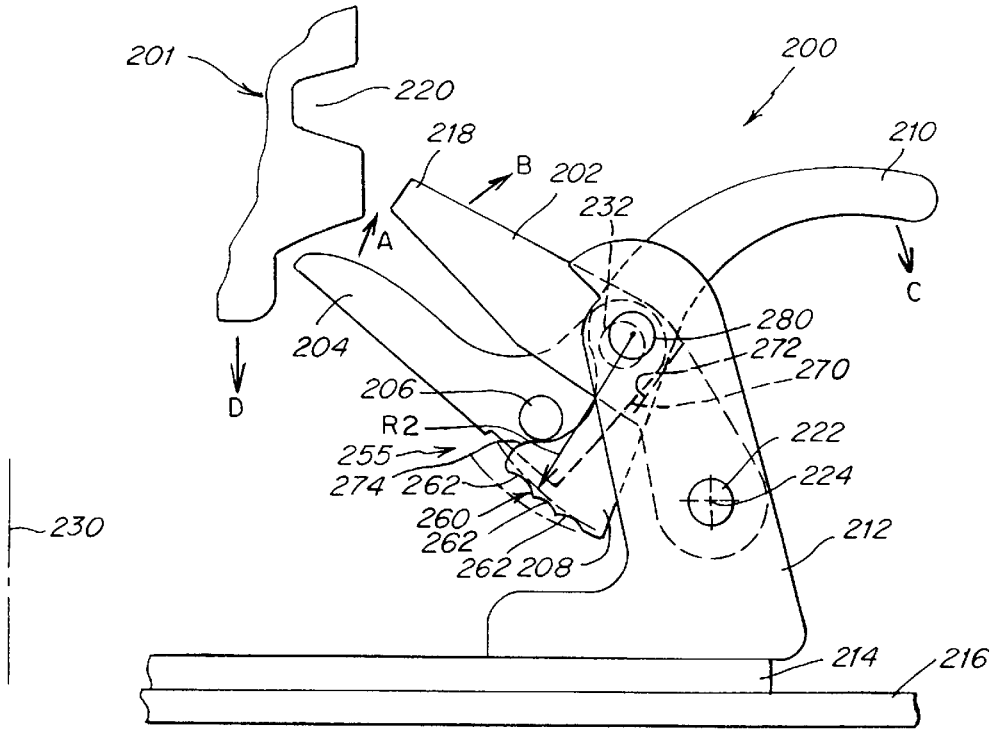
FIG. 10 illustrates a side view of a portion of an alternative binding mechanism in accordance with another embodiment of the invention.
Figure 11:
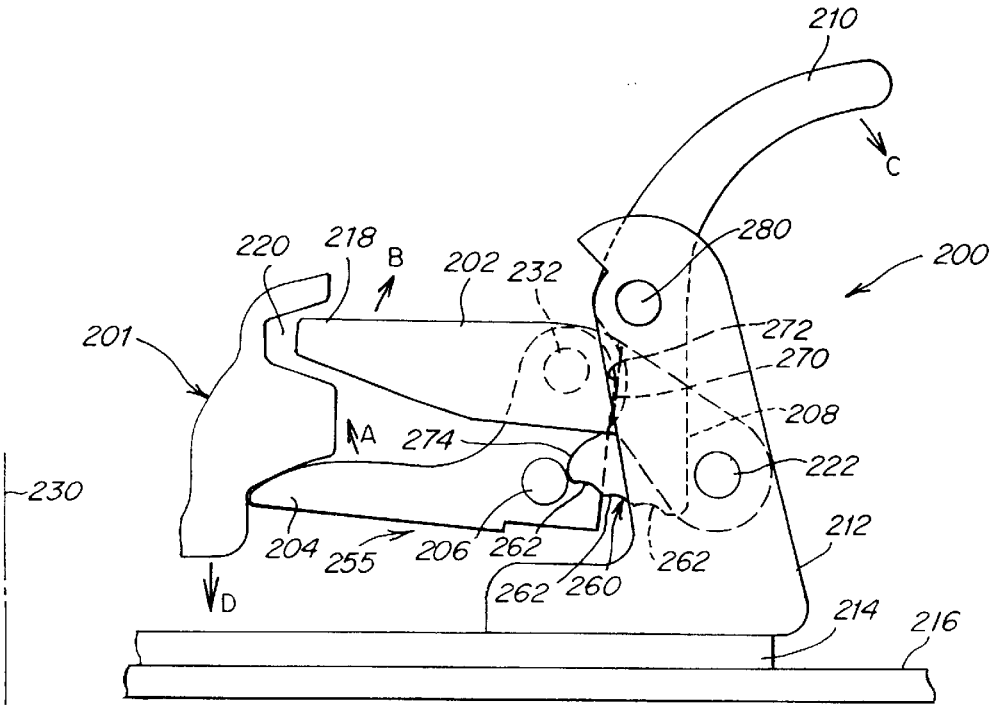
FIG. 11 is a side view of the binding mechanism of FIG. 10 showing a portion of the boot engaging the binding mechanism.

The trigger 204 is adapted to be stepped down upon by the boot 201 in order to move the binding mechanism 200 from the open configuration to a closed configuration. As shown in FIG. 10, when in the open configuration, the trigger 204 extends further inward toward the center line 230 of the binding than does the engagement member 202. This allows the snowboard boot 201 to step down upon the trigger 204 without interference from the engagement member 202.

In the illustrative embodiment shown, the trigger 204 is pivotally mounted to the engagement member 202 about a pivot pin 232, so that the trigger is pivotable relative to the engagement member. The trigger 204 is biased toward the open position as shown by arrow "A". As will be more fully described hereinafter, the trigger 204 is rotatably mounted relative to the engagement member 202 over a limited range such that, after a certain degree of rotation of the trigger 204 relative to the engagement member 202, further rotation of the trigger will cause rotation of the engagement member 202 toward the closed position.

In the illustrative embodiment shown, the handle 210 may be actuated to unlock the binding mechanism 200 and thereby allow the engagement member 202 to disengage from the boot 201. Although the binding mechanisms that engage both sides of the boot may be identical, in an alternative embodiment, a handle 40 need not be employed on one of the binding mechanisms for reasons discussed below.

The binding mechanism further includes a locking assembly 255 to hold the engagement member 218 in at least one closed position. In the embodiment shown in FIGS. 10–14, the locking assembly includes the catch pin 206 and the catch 208. The catch 208 always is biased toward the closed position in a direction shown by arrow "C" over its full range of motion. The catch 208, in this embodiment, is configured as an extension of the handle 210, although it is to be appreciated that the catch 208 may be formed as an independent component operably coupled to the handle 210.

As with the embodiment described with reference to FIGS. 1–9, the catch 208 includes a locking surface 260 that has a decreasing radius of curvature R2 relative to the pivot pin 280 to allow for multiple closed positions to compensate for varying amounts of snow, ice or debris lying beneath the boot. In this embodiment, however, a smaller radius of curvature provides the first closed position in which a maximum thickness of snow, ice or debris may be accommodated. In one embodiment, the thickness of snow, ice or other debris that may be accommodated beneath the boot may range between 0 mm and 8 mm, as shown by thickness "t" in FIG. 12. Of course, other ranges may be employed. When no snow, ice or debris is present, the sole of the boot may contact the base (if one is employed) or the snowboard directly.

As with the embodiment of FIG. 2 discussed above, the binding mechanism may be constructed to allow the engagement members 202 to automatically self-tighten, and the locking surface 260 may be formed with scallops 262 that engage with the catch pin 206 and are configured to produce an over-center action to reduce the likelihood that the catch pin 46 will slip from engagement with the locking surface 260. Further, as the engagement members 202 are not coupled together, they may move independently, thereby enabling independent compensation for any snow, ice or debris lying beneath the boot.

Figure 12:
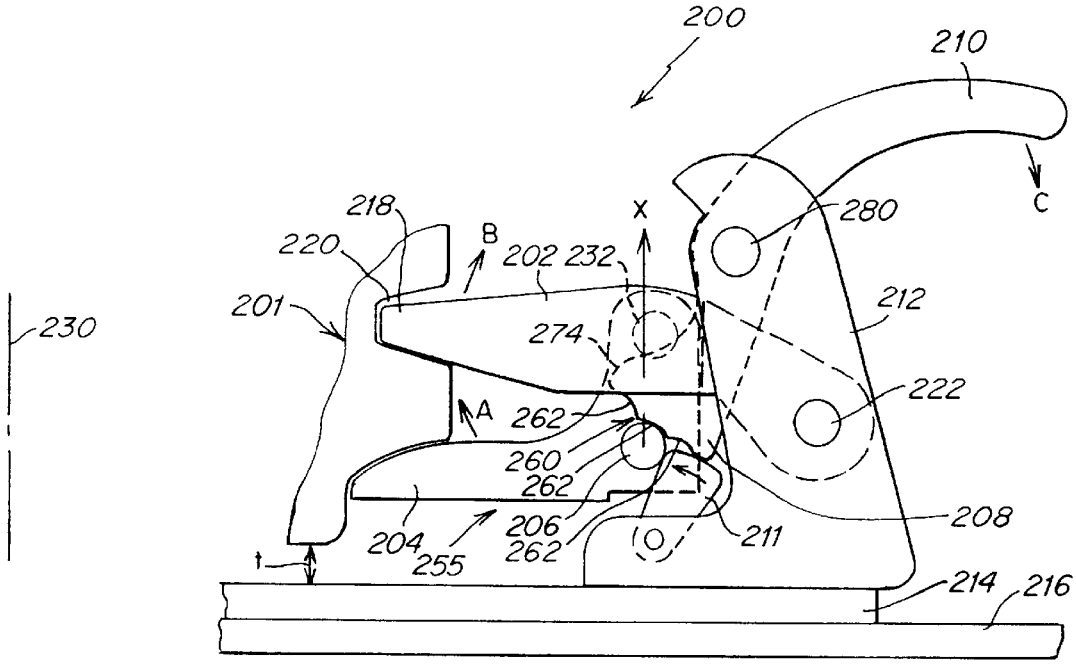
FIG. 12 is a side view of the binding mechanism of FIGS. 10–11 engaging the portion of the snowboard boot in a first locked position.
Figure 13:
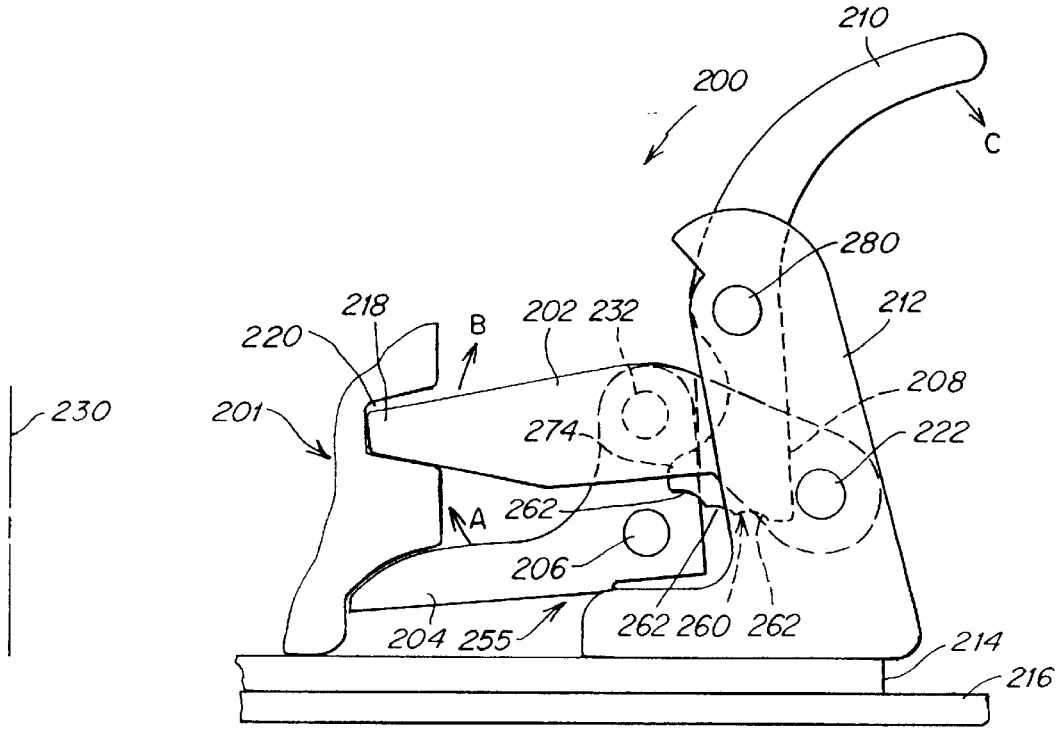
FIG. 13 is a side view of the binding mechanism of FIGS. 10–12 shown in an unlocked position.
Figure 14:
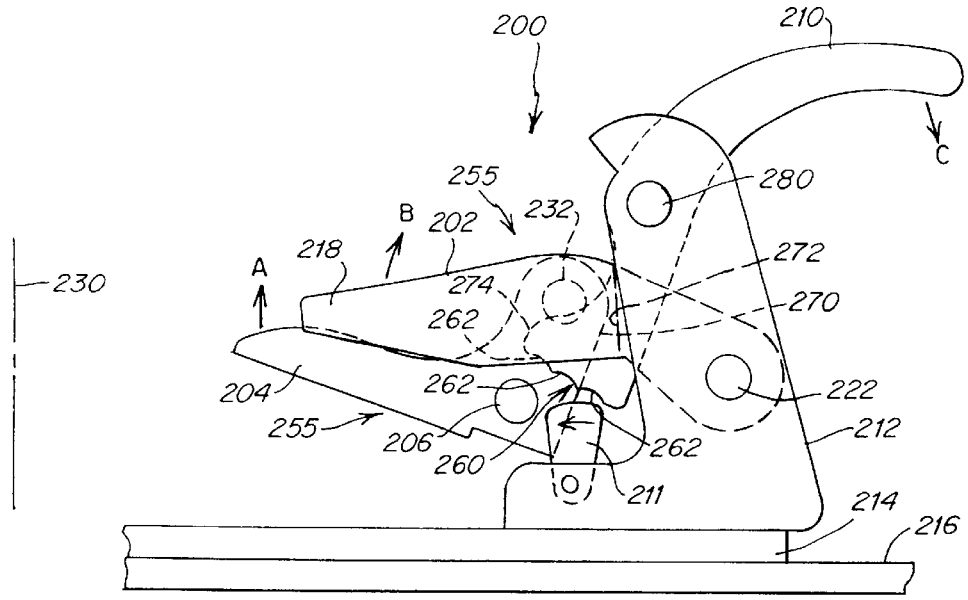
FIG. 14 is a side view of the binding mechanism of FIGS. 10–12 also shown in an unlocked position.

Initially, the engagement member 202 is held in the open position due to the action of the spring or other biasing element acting in direction "B." As the boot is stepped down upon the trigger 204 in a direction shown as arrow "D" (see FIGS. 10 and 11), the trigger 204 rotates relative to the engagement member 202 until a portion 270 of the trigger 204 engages with a portion 272 of the engagement member 202, so as to cause the trigger 204 and the engagement member 202 to move as a unit. The catch pin 206 then acts on an outer portion 274 of the catch 208, thereby causing the catch 208 to move (in a counterclockwise direction in FIG. 10) against the bias "C" (see FIG. 11). The engagement member 202 now begins to move into engagement with the boot 201. As the boot 201 continues to move downward, the catch pin clears the outer portion 274 of the catch 208, which causes the catch 208 to rotate about pivot point 280 (under the force of the bias "C" in a clockwise direction in FIG. 11) so that the catch pin 206 may engage with the locking surface 260. In FIG. 12, the locking pin is engaged in the second tightest of a plurality of engaged positions.

As best shown in FIG. 12, the boot 201 is held in the engaged position as follows. Any upward motion of the boot 201 that would tend to cause the engagement member 202 to rotate upwardly (i.e., clockwise in FIG. 12) about pivot pin 222 causes the trigger 204 to be pulled upwardly via its connection at 232 to the engagement member 202. This drives the catch pin 206 upwardly into the catch 208. In the embodiment shown, the locking assembly may be configured as an over-center locking assembly in which lifting forces tend to maintain the binding mechanism in the closed position. For example, the lifting force exerted by the catch pin 206 on the catch 208 may act on the catch 208 in the direction that would (if it could move) cause it to actually rotate more toward the closed position. This may be accomplished by positioning the pivot point 280 of the catch 208 on the frame at a position that is to the right of the line of force "X" (FIG. 12) caused by the catch pin 206, and ensuring that the geometry of the engaging surface 260 is such that the line of force "X" causes the catch to rotate (clockwise in FIG. 12) into the closed position.

In the embodiment shown in FIGS. 10–14, the trigger 204 is prevented from rotating upwardly (clockwise in FIG. 12) relative to the engagement member 202 so as to enable the catch pin 206 to disengage from the catch 208 via the interaction of the binding mechanism 200 and the boot 201. Specifically, for the trigger 204 to rotate upwardly relative to the engagement member 202, the boot 201 must clear the trigger 204. However, because the boot 201 is securely held in place, the trigger 204 cannot move, thereby keeping the locking mechanism closed.

Thus, to open the binding mechanism 200, the handle 210 is rotated (in a counter clockwise direction in FIG. 13) so that the locking surface 260 of the catch 208 moves away from the catch pin 206. Thus, when the boot is lifted, the engagement member 202 together with the trigger 206 is free to rotate (clockwise in FIG. 13) toward the open position.

As should be appreciated from the foregoing, in the illustrative embodiment of FIGS. 10–14, the boot itself plays a role in holding the binding mechanisms in the closed configuration. As a result, without the boot locked in place, both binding mechanisms automatically move to the open state because each is biased toward its open position. This is advantageous as it prevents the binding mechanism from locking in a closed position unless both binding mechanisms are properly engaged. This prevents false triggering of the binding, as can occur with many step-in bindings, where one engagement mechanism may move to and be locked in a closed position without the boot being properly secured in the binding, requiring that the rider reset the binding before stepping in.

False triggering cannot occur with the embodiment of FIGS. 10–14. Initially, the rider would have stepped into the binding as described above with one of the binding mechanisms closing. However, if the other binding mechanism is not properly secured, the boot 201 is able to move away from engagement with the binding mechanism 200. The trigger on the closed binding mechanism, being biased to rotate about the pivot pin 232 toward the open position, would cause the catch pin 206 to disengage from the catch 208. Now, upward rotation of the engagement member 202 is not resisted by the interaction of the catch pin 206 and the catch 208. The catch pin 206 on the trigger 204 is clear of the catch 208 and therefore the engagement member 202 is able to move to the open position. In addition, because the engagement member 202 is biased toward the open position, the binding mechanism 200 automatically resets to the open configuration.

In the embodiment shown in FIGS. 10–14, the binding mechanisms on both sides of the binding may be provided with a handle 210 to allow the binding mechanisms to move to the open configuration. However, as discussed above, the present invention is not limited in this respect, as the handle 210 may be provided on only one of the binding mechanisms, or on the boot, because removal of the boot from a first of the engagement members will allow a rider to rotate the boot so that it can move away from the other binding mechanism without actuation of any handle on the other binding mechanism.

Another aspect of the invention is directed to a binding that includes a unique heel hoop and base interface. As in known systems, the heel hoop may support a highback. The highback may be movably mounted to the heel hoop for rotation in a heel-to-toe direction for adjusting a desired forward-lean setting, and/or can be rotated about a vertical axis into a desired lateral position. However, this aspect of the invention is not limited to use with any particular highback configuration.

In the embodiment shown in FIGS. 1 and 15–18, the binding 20 includes a heel hoop 300 that is movably mounted to the base 38 in a manner further described below. The heel hoop 300 supports a highback 302 (FIG. 1) in a manner that allows the highback 302 to rotate about a substantially vertical axis 304, and to rotate in a heel-to-toe direction about an axis 306. To accomplish this, a pair of slots 308, 310 are formed in the heel hoop to adjustably receive a fastener (not shown) to hold the highback in a desired orientation. Such a mounting technique is shown in commonly assigned U.S. Pat. No. 5,356,170. However, the invention is not limited to any particular highback mounting technique.

Figure 15A:
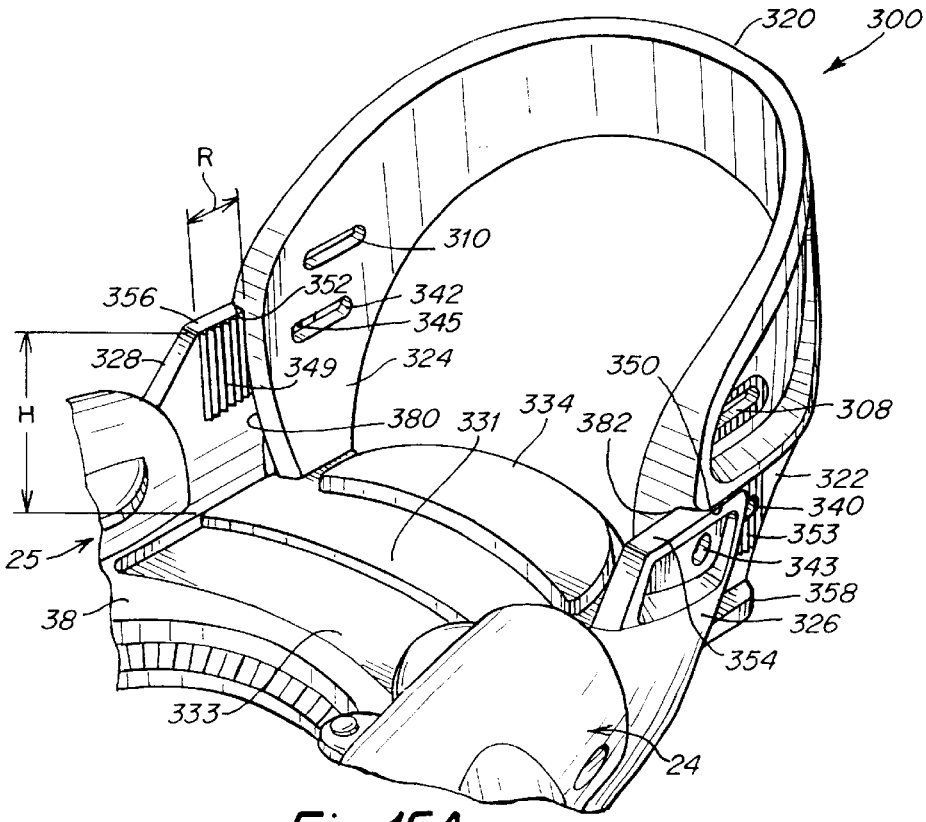
FIG. 15A is a perspective view of an alternate embodiment of the invention directed to a heel hoop, and shows the heel hoop in a first position relative to the binding base.
Figure 15B:
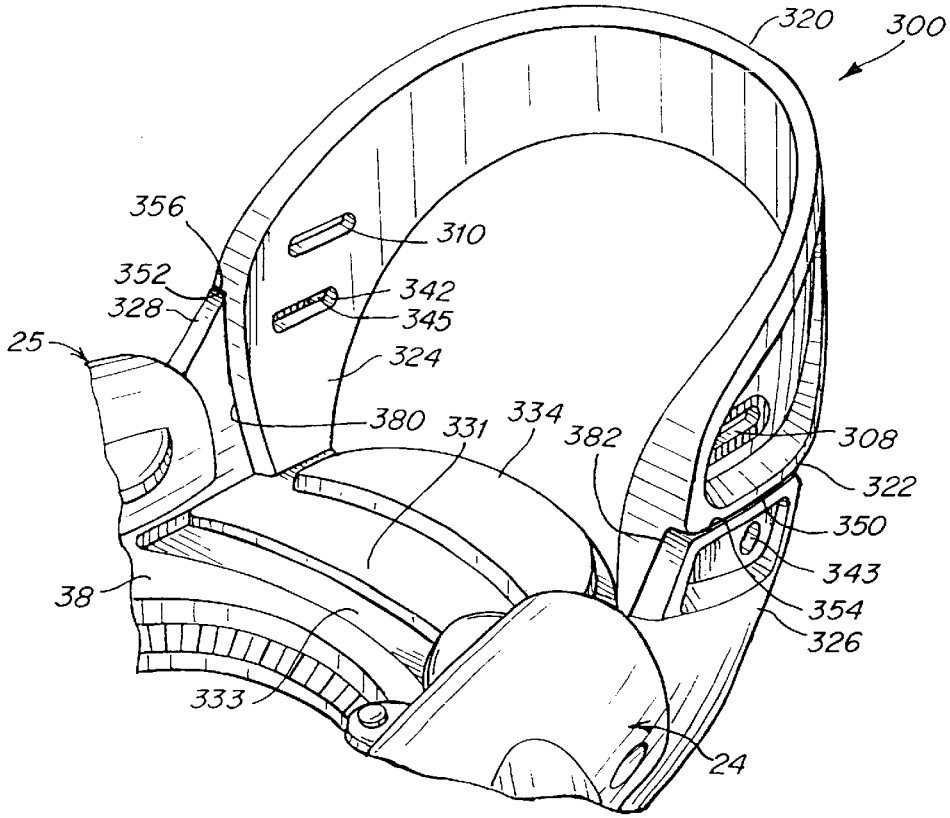
FIG. 15B is a perspective view of the heel hoop of FIG. 15A in a second position relative to the binding base.
Figure 16:
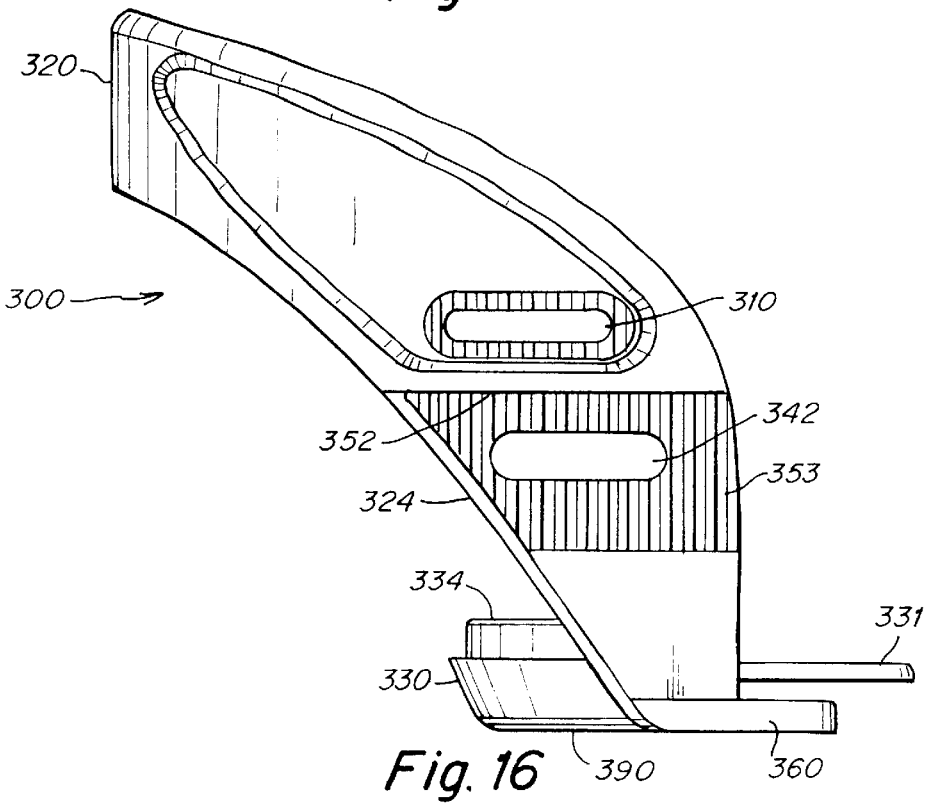
FIG. 16 is a side view of a portion of the heel hoop of FIGS. 15A and 15B.
Figure 17:
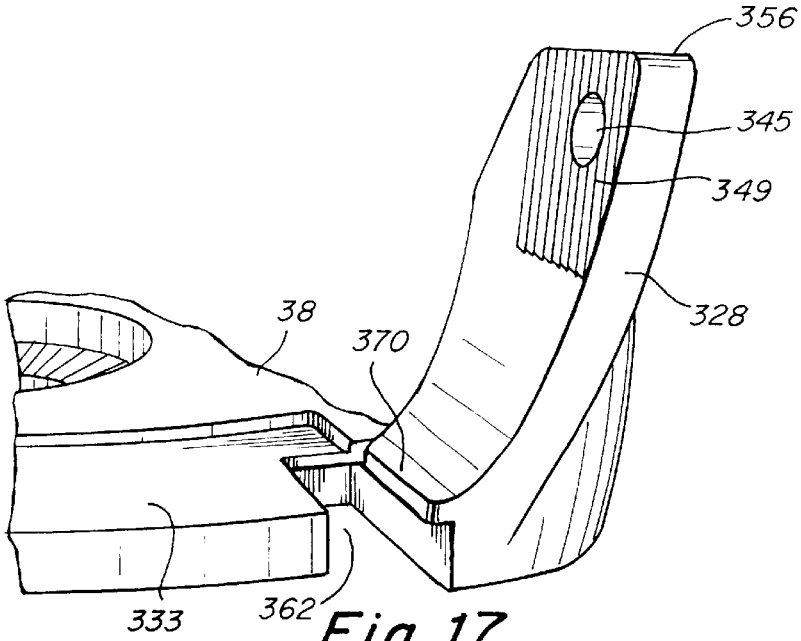
FIG. 17 is a rear perspective view of a portion of the base shown in FIGS. 15 and 16.
Figure 18:
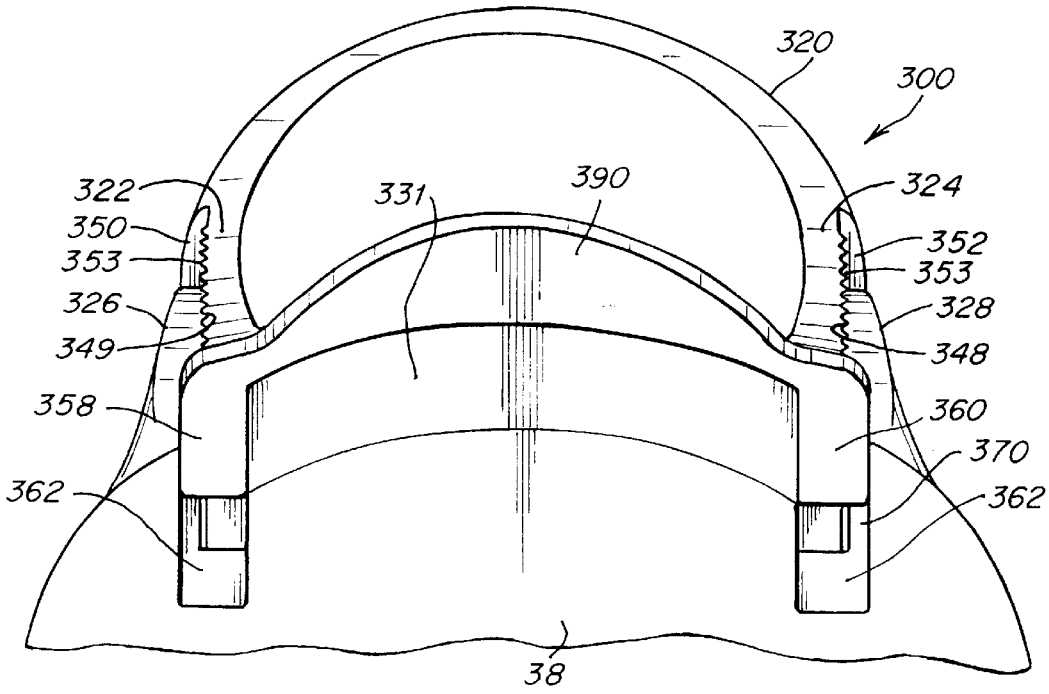
FIG. 18 is an underside view of a portion of the heel hoop and base of FIGS. 15–17.

In one illustrative embodiment, the heel hoop 300 includes a curved back portion 320, which is contacted by a portion of the highback 302. As shown in FIGS. 15A and 15B, side arms 322, 324 extend from the curved back portion 320 to engage with the base 38. In one illustrative embodiment, the curved back portion 320 and side arms 322, 324 are integrally formed as a single element. However, the invention is not limited in this respect, as the heel hoop 300 may be formed of multiple components.

The snowboard binding described herein may be employed with various size boots. When used with the step-in arrangements discussed above, the boot is center-registered by engagement of the boot with the engagement members. Therefore, the boot is fixed in a longitudinal direction of the binding. Accordingly, in the embodiment shown, the position of the heel hoop is adjustable relative to the base 38 to accommodate various size boots while providing a snug fit between the highback and the boot. Thus, in one illustrative embodiment, the heel hoop 300 is movably mounted to the binding base, telescopes therewithin, and may be fixed in a desired position. As shown in FIG. 15A, the heel hoop 300 is in one position relative to the base 38, wherein the heel hoop is positioned away from the center of the base such that the binding may receive a relatively large boot. In FIG. 15B, the heel hoop 300 is in another position relative to the base 38, wherein the heel hoop is positioned move forwardly toward the toe end of the base such that the binding may receive a relatively small boot. In one embodiment, the heel hoop 300 is adjustable over a range "R" of about 17 mm, although a larger or smaller range may be implemented. Such a range would accommodate boot sizes 4–10, in the case of small size bindings, and boot sizes 10–15, in the case of large size bindings.

In the embodiment described herein, the side arms 322, 324 of the heel hoop each engages towers 326, 328 of the base 38. The side arms 322, 324 each includes a slot 340, 342 and the towers 326, 328 of the base each includes a corresponding hole 343, 345 (see FIG. 1). The slots and holes cooperate to receive a fastener (not shown) to secure the heel hoop 300 in the desired position. The fastener may be a nut and bolt arrangement or any other suitable fastener, such as tool-free fastener, as the present invention is not limited in this respect. A plurality of ribs 348, 349 (see FIGS. 1 and 15A) may be formed on the towers 326, 328 and corresponding ribs 353 (see FIG. 1) may be formed on each side arm 322, 324 for added security. Although the slots are formed on the side arms and the holes are formed on the towers, the opposite configuration may be employed, wherein the slots are formed in the towers and the holes are formed in the side arms. In addition, although slots are employed, the invention is not limited in this respect as a series of spaced holes may be employed. Further, although the use of ribs is advantageous, this aspect of the invention is not limited to employing ribs.

The heel hoop that supports the high back must withstand significant forces as a rider leans against the high back. In particular, a heel hoop may be used to efficiently transfer forces from the high back to the snowboard as the rider leans against the high back while compensating for torque induced stress applied to the heel hoop. In at least one conventional binding, to movably mount a heel hoop while compensating for torque induced stress, the heel hoop is attached to the base at attachment points that are both forward and rearward of the engagement members such that a long lever arm of the heel hoop extends forward of the engagement member. An example of such a heel hoop construction may be found in commonly assigned application Ser. No. 09/442,779 (assigned U.S. Pat. No. 6,102,429).

In one embodiment of the present invention, the heel hoop 300 is adjustably mounted to the binding 20 in a manner such that no portion of the heel hoop 300 is attached forward of the engagement members. To provide adjustability, yet efficiently transfer forces to the board and enable the heel hoop and base interface to be able to withstand the large amount of torque induced stress imparted thereon, the heel hoop may be formed of a rigid material such as steel. Alternatively, the heel hoop 300 may be formed of a non-metallic material, such as plastic, and matingly engages with the towers 326, 328 and the binding base at a location that is behind the engagement members as shown in FIGS. 15A and 15B, yet adequately transfers forces and compensates for torque induced stress. As will become apparent, to adequately transfer forces and compensate for torque induced stress, the heel hoop engages with the base, preferably, although not necessarily, at more than one engaging location.

In one embodiment, the heel hoop engages with the base at a plurality of locations to compensate for torque induced stress. One such location is at the interfaces 380, 382 (see FIGS. 15A and 15B) between the side walls and the towers. Another location is at the interface between tops 354, 356 of the towers 326, 328 and ledges 350, 352 formed on the heel hoop 300 (see FIGS. 15A and 15B). In this respect, the ledges 350, 352 rest on tops 354, 356, respectively, of the towers 326, 328, such that forces applied to the heel hoop as a rider leans against the highback are resisted by tops of the towers engaging with the ledges. It should be appreciated that minimizing the amount of torque induced stress may be accomplished by maximizing the height "H" between the base 38 and the tops 354, 356 of the towers 326, 328 on which the ledges 350, 352 of the heel hoop 300 rest (see FIG. 15A). In one embodiment, this distance may be between approximately 20 mm and approximately 55 mm and more preferably between approximately 35 mm and approximately 50 mm, and even more preferably approximately 40 mm.

In one embodiment, a portion of the base 38 overlies a portion of the heel hoop 300, thereby providing yet another location where the heel hoop engages with the base. In the embodiment shown in FIGS. 1 and 16, the lower ends of the side arms 322, 324 terminate with feet 358, 360 extending outwardly therefrom that bear against the upper surface of the snowboard when the binding is secured thereto. The base 38 is formed with corresponding channels 362 (see FIGS. 1, 17 and 18), which slidingly receive the feet 358, 360, therein. The channels 362 each includes a cap 370 (see FIGS. 17 and 18), which is configured to overlie at least a portion of the side and the front of the feet when the feet are positioned within the channels. Thus, forces applied to the heel hoop as a rider leans against the highback are resisted by caps 370 engaging with the feet 360.

Although the embodiments shown herein include certain engaging configurations of the heel hoop and the base, the present invention is not limited in this respect as other engaging locations may be employed.

In one embodiment, the heel hoop 300 may include a base portion or cross member 330, which underlies the rider's boot and interconnects the opposing sides arms 322, 324. Thus, the cross member may be employed to enhance the structural integrity of the heel hoop 320 by joining the side arms in a relatively rigid manner. The cross member may also serve to transfer forces directly to the board. In this respect, as shown most clearly in FIGS. 16 and 18, the cross member further includes a snowboard engaging surface 390 that bears directly against the upper surface of the snowboard when the binding is attached thereto. To minimize any damage to the surface of the snowboard as forces are imparted onto the heel hoop, the snowboard engaging surface 390 includes a suitable surface area, which may depend upon the particular material or structure forming the snowboard.

In one embodiment, the cross member 330 includes a forward portion 331 that slides over the base 38 within a mating recess 333. The binding may also include a heel pad 334 that may be suitably positioned on the upper surface of the cross member to eliminate any gap between the boot and the snowboard to enhance board response. In one embodiment, the heel pad 334 is mounted to the cross member 330 and may extend to the forward portion 331. The binding may also include a toe pad 336 (see FIG. 1), which may be mounted to the toe end of the base 38 to eliminate any gap between the toe area of the boot and the base. It is to be appreciated, however, that the present invention is not limited in this respect and that neither a heel pad nor a toe pad need be employed.

Although the adjustable heel hoop is described herein in conjunction with a step-in binding, the present invention is not limited in this respect, as the adjustable heel hoop may be employed with other types of bindings.

As discussed above, various combinations of the above-described embodiments can be employed together. However, these aspects of the invention are not limited in this respect. Therefore an aspect of the invention described with reference to a certain embodiment may be employed in other embodiments or in various combinations of other embodiments.

Having thus described certain embodiments of the present invention, various alterations, modification and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalent thereof.

What is claimed is:

1. A step-in snowboard binding for securing a snowboard boot to a snowboard, comprising:

a base;

a heel hoop mounted to the base;

at least one strapless engagement member, moveably mounted relative to the base, adapted to engage at least one lateral side of the snowboard boot at a section not forward of an in-step area of the snowboard boot; and a high-back leg support supported by the heel hoop.

2. The step-in snowboard binding of claim 1, wherein the at least one strapless engagement member includes a first strapless engagement member, moveably mounted to the base, adapted to engage a first lateral side of the snowboard boot at a section not forward of the in-step area and a second strapless engagement member, mounted to the base opposite the first strapless engagement member and adapted to engage a second side of the snowboard boot at a section not forward of the in-step area;

wherein each of the first and second strapless engagement members is arranged to engage a mid-section of the snowboard boot rearward of a ball area and forward of a heel area;

wherein the first strapless engagement member is mounted to the base for rotation about a first axis that extends in a substantially toe-to-heel direction of the binding and the second strapless engagement member is mounted to the base for rotation about a second axis that extends substantially in the toe-to-heel direction of the binding;

wherein the binding further includes a first trigger coupled to the first strapless engagement member and adapted to draw the first strapless engagement member into engagement with the snowboard boot when the snowboard boot is stepped into the binding; and wherein the binding further includes a second trigger coupled to the second strapless engagement member and adapted to draw the second strapless engagement member into engagement with the snowboard boot when the snowboard boot is stepped into the binding.

3. The step-in snowboard binding of claim 2, wherein the first strapless engagement member is movable between a closed position wherein it secures the snowboard boot to the binding and an open position wherein it does not secure the snowboard boot to the binding; and wherein the binding further comprises a first locking assembly adapted to lock the first strapless engagement member in the closed position, wherein the first locking assembly has an open state and a closed state respectively corresponding to the open and closed positions of the first strapless engagement member, the first locking assembly being arranged to lock the first strapless engagement member in the closed position when the locking assembly is in the closed state, the first locking assembly being constructed and arranged such that, when the boot is secured to the binding, forces acting through the boot on the first engagement member that tend to move the first engagement member toward the open position act to maintain the locking assembly in the closed state.

4. The step-in snowboard binding of claim 2, wherein a position of the heel hoop is adjustable relative to the first and second strapless engagement members to accommodate different sizes of the snowboard boot.

5. The snowboard binding of claim 1, in combination with the snowboard boot.

6. A step-in snowboard binding for securing a snowboard boot to a snowboard, comprising:

a base having a base surface adapted to be substantially parallel to a sole of the snowboard boot when the boot is secured in the binding;

at least one strapless engagement member, moveably mounted to the base, adapted to engage the snowboard boot; and a high-back leg support mounted to the base in at least two positions having different rotational orientations about an axis that is substantially normal to the base surface.

7. A step-in snowboard binding for securing a snowboard boot to a snowboard, comprising:

a base adapted to receive the snowboard boot;

at least one strapless engagement member that is mounted to the base and adapted to engage at least one lateral side of the snowboard boot at a section not forward of an in-step area of the snowboard boot; and a heel hoop adapted to receive a heel of the snowboard boot, the heel hoop being adjustably mounted to the base to enable adjustment of a distance separating the heel hoop and the at least one strapless engagement member in a length direction of the binding to enable the binding to accommodate different sizes of the snowboard boot.

8. The step-in snowboard binding of claim 7, wherein the at least one strapless engagement member includes a first strapless engagement member, moveably mounted to the base, adapted to engage a first lateral side of the snowboard boot at a section not forward of the in-step area and a second strapless engagement member, mounted to the base opposite the first strapless engagement member and adapted to engage a second side of the snowboard boot at a section not forward of the in-step area;

wherein each of the first and second strapless engagement members is arranged to engage a mid-section of the snowboard boot rearward of a ball area and forward of a heel area;

wherein the first strapless engagement member is mounted to the base for rotation about a first axis that extends substantially in a toe-to-heel direction of the binding and the second strapless engagement member is mounted to the base for rotation about a second axis that extends substantially in the toe-to-heel direction of the binding;

wherein the binding further includes a first trigger coupled to the first strapless engagement member and adapted to draw first strapless engagement member into engagement with the snowboard boot when the snowboard boot is stepped into the binding; and wherein the binding further includes a second trigger coupled to the second strapless engagement member and adapted to draw the second strapless engagement member into engagement with the snowboard boot when the snowboard boot is stepped into the binding.

9. The step-in snowboard binding of claim 8, wherein the first strapless engagement member is movable between a closed position wherein it secures the snowboard boot to the binding and an open position wherein it does not secure the snowboard boot to the binding; and wherein the binding further comprises a first locking assembly adapted to lock the first strapless engagement member in the closed position, wherein the first locking assembly has an open state and a closed state respectively corresponding to the open and closed positions of the first strapless engagement member, the first locking assembly being arranged to lock the first strapless engagement member in the closed position when the locking assembly is in the closed state, the first locking assembly being constructed and arranged such that, when the boot is secured to the binding, forces acting through the boot on the first engagement member that tend to move the first engagement member toward the open position act to maintain the locking assembly in the closed state.

10. The step-in snowboard binding of claim 8, further including a high-back leg support supported by the heel hoop, wherein the base includes a base surface adapted to be substantially parallel to a sole of the snowboard boot when the boot is secured in the binding, and wherein the binding is constructed and arranged to enable the high-back leg support to be mounted to the base in at least two positions having different rotational orientations about an axis that is substantially normal to the base surface.

11. The step-in snowboard binding of claim 7, in combination with the snowboard boot.

12. A snowboard boot binding for securing a snowboard boot to a snowboard, comprising:

a base adapted to receive the snowboard boot;

a first engagement member mounted to the base for movement between a first open position and a first closed position, the first engagement member being adapted to engage a first lateral side of the snowboard boot when in the first closed position;

a first locking assembly having a first open state and a first closed state respectively corresponding to the first open position and the first closed position of the first engagement member, the first locking assembly being arranged to lock the first engagement member in the first closed position when the first locking assembly is in the first closed state, the first locking assembly being constructed and arranged such that, when the boot is secured to the binding, forces acting through the boot on the first engagement member that tend to move the first engagement member from the first closed position toward the first open position act to maintain the first locking assembly in the closed state;

a second engagement member mounted to the base for movement between a second open position and a second closed position, the second engagement member being adapted to engage a second lateral side of the snowboard boot when in the second closed position; and a second locking assembly having a second open state and a second closed state respectively corresponding to the second open position and the second closed position of the second engagement member, the second locking assembly being arranged to lock the second engagement member in the second closed position when the second locking assembly is in the second closed state, the second locking assembly being constructed and arranged such that, when the boot is secured to the binding, forces acting through the boot on the second engagement member that tend to move the second engagement member from the second closed position toward the second open position act to maintain the second locking assembly in the closed state.

13. The snowboard binding of claim 12, further comprising:

a first trigger mechanically coupled to the first engagement member and adapted to be stepped on to move the first engagement member from the first open position to the first closed position when the snowboard boot is stepped into the binding;

a second trigger mechanically coupled to the second engagement member and adapted to be stepped on to move the second engagement member from the second open position to the second closed position when the snowboard boot is stepped into the binding;

a heel hoop mounted to the base; and a high-back leg support supported by the heel hoop.

14. The snowboard binding of claim 13, in combination with the snowboard boot.

15. A step-in snowboard binding for securing a snowboard boot to a snowboard, comprising:

a base having a baseplate adapted to be mounted to the snowboard;

a first strapless engagement member that is moveably mounted to the base between a first open position and a first closed position in which the first strapless engagement member is adapted to engage a first lateral side of the snowboard boot at a section not forward of the in-step area, the first strapless engagement member being mounted for rotation relative to the base about a first axis that extends substantially in a heel-to-toe direction of the binding;

a first trigger coupled to the first strapless engagement member and adapted to be stepped on by the boot when the boot is stepped into the binding and to draw the first strapless engagement member from the first open position to the first closed position wherein the first trigger is arranged to protrude further toward a centerline of the binding than the first strapless engagement member;

second strapless engagement member that is moveably mounted to the base between a second open position and a second closed position in which the second strapless engagement member is adapted to engage a second lateral side of the snowboard boot at a section not forward of the in-step area, the second strapless engagement member being mounted for rotation relative to the base about a second axis that extends substantially in a heel-to-toe direction of the binding;

a second trigger coupled to the second strapless engagement member and adapted to be stepped on by the boot when the boot is stepped into the binding and to draw the second strapless engagement member from the second open position to the second closed position, wherein the second trigger is arranged to protrude farther toward the centerline of the binding than the second strapless engagement member;

a heel hoop that is adjustably mounted to the base to accommodate different sizes of the snowboard boot; and a high-back leg support supportable by the heel hoop in at least two positions having different rotational orientations about an axis that is substantially normal to the baseplate.

16. The step-in snowboard binding of claim 15, wherein each of the first and second strapless engagement members is adapted to engage the snowboard boot at the in-step area.

17. The step-in snowboard binding of claim 15, further comprising:

a first locking assembly adapted to lock the first strapless engagement member in the first closed position, wherein the first locking assembly has a first open state and a first closed state respectively corresponding to the first open and first closed positions of the first strapless engagement member the first locking assembly being arranged to lock the first strapless engagement member in the first closed position when the first locking assembly is in the first closed state, the first locking assembly being constructed and arranged such that, when the boot is secured to the binding, forces acting through the boot on the first engagement member that tend to move the first engagement member toward the first open position act to maintain the first locking assembly in the first closed state; and a second locking assembly adapted to lock the second strapless engagement member in the second closed position, wherein the second locking assembly has a second open state and a second closed state respectively corresponding to the second open and second closed positions of the second strapless engagement member, the second locking assembly being arranged to lock the second strapless engagement member in the second closed position when the second locking assembly is in the second closed state, the second locking assembly being constructed and arranged such that, when the boot is secured to the binding, forces acting through the boot on the second engagement member that tend to move the second engagement member toward the second open position act to maintain the second locking assembly in the second closed state.

18. The snowboard binding of claim 15, in combination with the snowboard boot.

19. A snowboard binding mechanism for use with a snowboard binding, the mechanism for securing a snowboard boot to a snowboard, the mechanism comprising:

at least one movable engagement member movable between an open position and at least one closed position wherein the engagement member is adapted to secure the boot to the snowboard, the at least one engagement member being biased toward the open position when in the at least one closed position and being constructed and arranged to automatically re-set to the open position when the boot is not in the binding;

at least one locking assembly having a catch adapted for rotation independently of the at least one engagement member, and a trigger adapted for rotation independently of the at least one engagement member, the catch and the trigger engaging with each other to lock the at least one engagement member in the at least one closed position.

20. The mechanism according to claim 19, wherein the at least one locking assembly is arranged so that the boot holds the catch in engagement with the trigger when the boot is secured within the binding.

21. The mechanism according to claim 19, wherein the at least one locking assembly includes an unlocked configuration corresponding to the open position and at least one locked configuration corresponding to the at least one closed position, wherein the trigger is biased away from the catch.

22. The mechanism according to claim 21, wherein the at least one closed position includes a plurality of closed positions, and wherein the at least one locked configuration includes a plurality of locked configurations corresponding to the plurality of closed positions, wherein the trigger is always biased away from the catch.

23. The mechanism according to claim 19, wherein the at least one engagement member comprises first and second engagement members and wherein the at least one locking assembly comprises first and second locking assemblies, respectively adapted to lock the first and second engagement members.

24. The mechanism according to claim 23, wherein the at least one closed position comprises a plurality of closed positions corresponding to a plurality of different amounts of snow, ice or debris lying beneath the boot, wherein the catch includes a surface having an increasing radius, the surface being adapted to hold the trigger in any one of the plurality closed positions depending upon the amount of snow, ice or debris lying beneath the boot.

25. The mechanism according to claim 23, wherein the first locking mechanism is adapted for rotation independently of the first engagement member and wherein the second locking mechanism is adapted for rotation independently of the second engagement member.

26. The mechanism according to claim 19, further comprising a handle coupled to the catch, wherein actuation of the handle moves the catch out of engagement with the first trigger.

27. A snowboard binding mechanism for use with a snowboard binding, the mechanism for securing a snowboard boot to a snowboard, the mechanism comprising:

at least one movable engagement member movable between an open position and at least one closed position wherein the engagement member is adapted to secure the boot to the snowboard, the at least one engagement member being biased toward the open position when in the at least one closed position and being constructed and arranged to automatically re-set to the open position when the boot is not in the binding;

a trigger movably mounted to the at least one engagement member, the trigger being constructed and arranged to move the at least one movable engagement member from the open position to the at least one closed position, wherein the trigger is pivotally mounted to the at least one engagement member.

28. The mechanism according to claim 27, wherein the trigger is adapted to rotate relative to the at least one engagement member over a limited range.

29. A snowboard binding for securing a snowboard boot to a snowboard, the binding comprising:

a base adapted to receive the boot;

a first engagement member mounted to the base for movement between a first open position and at least one first closed position wherein the first engagement member is adapted to engage a first portion of the boot;

a first locking mechanism movable between a first unlocked configuration corresponding to the first open position of the first engagement member and at least one first locked configuration corresponding to the at least one first closed position of the first engagement member, wherein the first locking mechanism locks the first engagement member in the at least one first closed position when in the at least one first locked configuration;

an actuator, operably coupled to the first locking mechanism, adapted to disengage the first locking mechanism from the first engagement member by moving the first locking mechanism to its unlocked configuration;

a second engagement member mounted to the base for movement between a second open position and at least one second closed position wherein the second engagement member is adapted to engage a second portion of the boot, the second engagement member being adapted to move between the second open position and the at least one second closed position independently of the first engagement member moving between the first open position and the at least one first closed position; and a second locking mechanism movable between a second unlocked configuration corresponding to the second open position of the second engagement member and at least one second locked configuration corresponding to the at least one second closed position of the second engagement member, wherein the second locking mechanism locks the second engagement member in the at least one second closed position when in the at least one locked configuration;

wherein the binding is free of an actuator that is adapted to disengage the second locking mechanism from the second engagement member by moving the second locking mechanism to its unlocked configuration.

* * * * *